US011446725B2

(12) United States Patent
Dole

(10) Patent No.: US 11,446,725 B2
(45) Date of Patent: Sep. 20, 2022

(54) PIPE GROOVING DEVICE HAVING FLARED CUP

(71) Applicant: Victaulic Company, Easton, PA (US)

(72) Inventor: Douglas R. Dole, Whitehouse Station, NJ (US)

(73) Assignee: Victaulic Company, Easton, PA (US)

( * ) Notice: Subject to any disclaimer, the term of this patent is extended or adjusted under 35 U.S.C. 154(b) by 0 days.

(21) Appl. No.: 16/998,385

(22) Filed: Aug. 20, 2020

(65) Prior Publication Data

US 2021/0053102 A1 Feb. 25, 2021

Related U.S. Application Data

(60) Provisional application No. 62/889,671, filed on Aug. 21, 2019.

(51) Int. Cl.

| | |
|---|---|
| ***B21D 17/04*** | (2006.01) |
| ***B21D 51/12*** | (2006.01) |
| ***B21D 15/06*** | (2006.01) |

(52) U.S. Cl.

CPC ..... *B21D 17/04* (2013.01); *B21D 15/06* (2013.01); *B21D 51/12* (2013.01)

(58) Field of Classification Search

CPC ..... B21D 15/04; B21D 15/06; B21D 17/02; B21D 17/04; B21D 51/12; B21D 51/2607

See application file for complete search history.

(56) References Cited

U.S. PATENT DOCUMENTS

| | | | |
|---|---|---|---|
| 1,414,668 | A | 5/1922 | Reed |
| 2,004,816 | A | 6/1935 | Lindgren |
| 2,089,475 | A | 8/1937 | Grotnes |
| 2,179,849 | A | 11/1939 | Freeze |
| 2,679,089 | A | 5/1954 | Opitz et al. |
| 2,684,101 | A | 7/1954 | Clerke |
| 2,686,442 | A | 8/1954 | Wilson |
| 2,809,687 | A | 10/1957 | Ogle |
| 2,821,099 | A | 1/1958 | Beecher |
| 2,942,567 | A | 6/1960 | Kargard et al. |

(Continued)

FOREIGN PATENT DOCUMENTS

| | | | |
|---|---|---|---|
| CN | 201249229 | Y | 6/2009 |
| CN | 201320572 | Y | 10/2009 |

(Continued)

OTHER PUBLICATIONS

Author Unknown; SP—The Best Pipe in the World, Company Website, Products, Press Fittings; obtained online at http://www.superpipe.co.za/SP_PressFittings.htm on Jan. 29, 2020; pp. 1-2.

*Primary Examiner* — Debra M Sullivan
(74) *Attorney, Agent, or Firm* — Ballard Spahr LLP

(57) ABSTRACT

A pipe grooving device has a flared cup which surrounds a pipe end stop. The cup and the pipe end stop are mounted on a fixed pinion about which a carriage rotates. The carriage carries geared cams which engage the pinion and rotate synchronously when the carriage rotates relatively the pinion. The cams engage a pipe element received by the cup and form a circumferential groove in the pipe element. The cup and the pipe stop move independently of one another axially along a pinion shaft to actuate rotation of the carriage. The flared cup accommodates dimensional pipe diameter tolerances and mitigates pipe flare and maintains pipe roundness during the grooving process.

24 Claims, 22 Drawing Sheets

(56) References Cited

U.S. PATENT DOCUMENTS

| | | | |
|---|---|---|---|
| 3,260,089 | A | 7/1966 | Hazelton et al. |
| 3,260,090 | A | 7/1966 | Sofranko |
| 3,277,684 | A | 10/1966 | Gareri |
| 3,299,680 | A | 1/1967 | Thompson |
| 3,383,892 | A | 5/1968 | Brothen |
| 3,387,477 | A | 6/1968 | Shupper |
| 3,473,359 | A | 10/1969 | Joslin |
| 3,564,887 | A | 2/1971 | Novak et al. |
| 3,595,049 | A | 7/1971 | Holt |
| 3,686,917 | A | 8/1972 | Hikida et al. |
| 3,717,017 | A | 2/1973 | Vukovich |
| 3,827,269 | A | 8/1974 | Hoagland et al. |
| 3,831,416 | A | 8/1974 | Wolfe |
| 3,869,895 | A | 3/1975 | Holub |
| 4,018,462 | A | 4/1977 | Saka |
| 4,043,161 | A | 8/1977 | Toma et al. |
| 4,142,393 | A | 3/1979 | Nagel |
| 4,143,535 | A | 3/1979 | Bouman |
| 4,173,877 | A | 11/1979 | Kreiskorte |
| 4,372,026 | A | 2/1983 | Mosing |
| 4,389,875 | A | 6/1983 | Grotnes, II |
| 4,660,803 | A | 4/1987 | Johnston et al. |
| 4,838,066 | A | 6/1989 | Marcon et al. |
| 5,002,318 | A | 3/1991 | Witter |
| 5,040,729 | A | 8/1991 | Carrozza |
| 5,245,848 | A | 9/1993 | Lee, Jr. et al. |
| 5,291,769 | A | 3/1994 | Miyano |
| 5,435,213 | A | 7/1995 | Buck |
| 5,479,961 | A | 1/1996 | DeMarsh et al. |
| 5,528,919 | A | 6/1996 | McGrady et al. |
| 5,778,715 | A | 7/1998 | Lippka |
| 5,911,939 | A | 6/1999 | Jenkins |
| 5,950,472 | A | 9/1999 | Grotnes |
| 6,145,892 | A | 11/2000 | Weber |
| 6,257,627 | B1 | 7/2001 | Fujiwara et al. |
| 6,272,895 | B1 | 8/2001 | Hamm |
| 6,338,263 | B1 | 1/2002 | Obata et al. |
| 6,547,785 | B1 | 4/2003 | Katayama et al. |
| 6,776,018 | B2 | 8/2004 | Hamm et al. |
| 6,968,719 | B2 | 11/2005 | Zifferer |
| 6,976,712 | B2 | 12/2005 | Lukach |
| 7,997,112 | B2 | 8/2011 | Sandman et al. |
| 9,003,851 | B2 | 4/2015 | Obata et al. |
| 10,525,516 | B2 | 1/2020 | Dole |
| 10,525,517 | B2 | 1/2020 | Dole |
| 10,960,450 | B2 | 3/2021 | Dole |
| 11,173,533 | B2 | 11/2021 | Dole |
| 2002/0007514 | A1 | 1/2002 | Dole et al. |
| 2002/0129684 | A1 | 9/2002 | Oswald |
| 2003/0192357 | A1 | 10/2003 | Hamm et al. |
| 2003/0226387 | A1 | 12/2003 | Dole et al. |
| 2004/0221635 | A1 | 11/2004 | Bauder |
| 2005/0178179 | A1 | 8/2005 | Dole |
| 2006/0011017 | A1 | 1/2006 | Kathan |
| 2008/0012326 | A1 | 1/2008 | Braathen et al. |
| 2011/0232434 | A1 | 9/2011 | Bortoli |
| 2011/0271797 | A1 | 11/2011 | Light et al. |
| 2016/0236256 | A1 | 8/2016 | Price et al. |
| 2017/0151596 | A1 | 6/2017 | Dole |
| 2018/0318694 | A1 | 11/2018 | Paglierani et al. |
| 2019/0184441 | A1 | 6/2019 | Dole |
| 2020/0016644 | A1 | 1/2020 | Dole |
| 2020/0070231 | A1 | 3/2020 | Dole |
| 2020/0070232 | A1 | 3/2020 | Dole |
| 2020/0070233 | A1 | 3/2020 | Dole |
| 2021/0170468 | A1 | 6/2021 | Dole |

FOREIGN PATENT DOCUMENTS

| | | | |
|---|---|---|---|
| CN | 101856706 | A | 10/2010 |
| CN | 202100679 | U | 1/2012 |
| CN | 102699168 | A | 10/2012 |
| CN | 202834505 | U | 3/2013 |
| CN | 204523912 | U | 8/2015 |
| DE | 2441387 | | 3/1976 |
| DE | 102006062208 | | 6/2008 |
| EP | 1038603 | | 9/2000 |
| GB | 1317148 | | 5/1973 |
| JP | S63126623 | | 5/1988 |
| JP | H11207411 | A | 8/1999 |
| RU | 2071852 | C1 | 1/1997 |
| RU | 2147957 | C1 | 4/2000 |
| SU | 628973 | A1 | 10/1978 |
| SU | 1687330 | A1 | 10/1991 |
| TW | 291451 | B | 11/1996 |

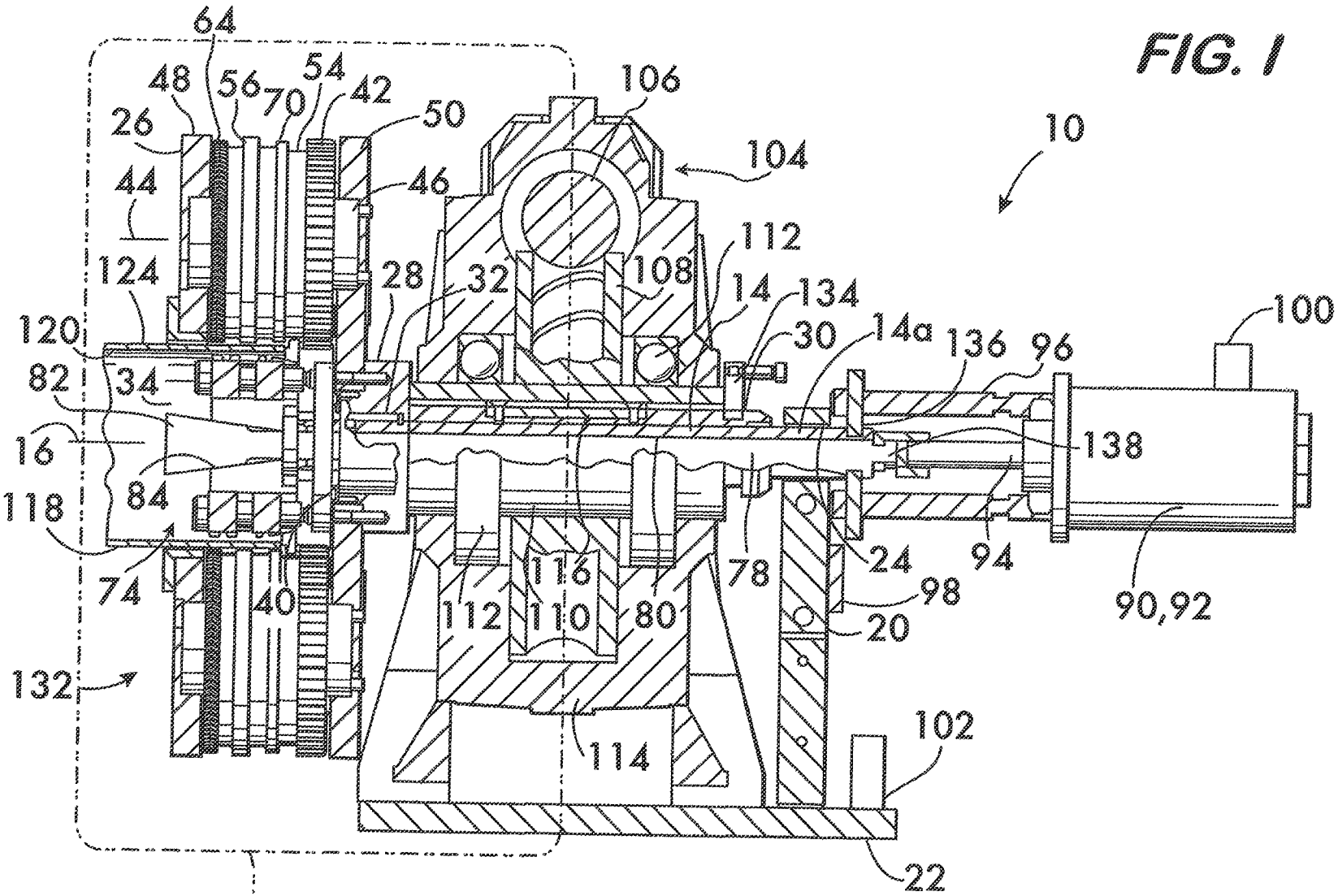
FIG. IA 10
104
106
64
56
54
70
42
48
50
26
46
44
108
124
28
120
88a
86
110
34
12
14
82
84
18
32
116
78
16
88
30
74
76
38
118
36
40
112
114

10
100
90,92
94
96
138
136
24
98
14a
20
102
22
134
14
30
78
104
112
108
106
80
114
110
116
28
32
50
46
54
70
42
56
64
48
26
44
124
34
82
84
76
120
118
16
74
12
132

64
56
70
54
42
50
104
106
48
26
46
108
44
124
12
118
34
28
88a
30
86
14
16
82
18
32
116
78
74
84
110
76
120
38
112
40
114
22

PIPE GROOVING DEVICE HAVING FLARED CUP

CROSS REFERENCE TO RELATED APPLICATION

This application is based upon and claims benefit of priority to U.S. Provisional Application No. 62/889,671, filed Aug. 21, 2019 and hereby incorporated by reference herein.

FIELD OF THE INVENTION

This invention relates to machines using cams to cold work pipe elements.

BACKGROUND

Cold working of pipe elements, for example, impressing a circumferential groove in a pipe element to accept a mechanical pipe coupling, is advantageously accomplished using roll grooving machines having an inner roller which engages an inside surface of the pipe element and an outer roller which simultaneously engages an outside surface of the pipe element opposite to the inner roller. As the pipe is rotated about its longitudinal axis, often by driving the inner roller, the outer roller is progressively forced toward the inner roller. The rollers have surface profiles which are impressed onto the pipe element circumference as it rotates, thereby forming a circumferential groove.

There are various challenges which this technique faces if it is to cold work pipe elements with the required tolerances to the necessary precision. Most pressing are the difficulties associated with producing a groove of the desired radius (measured from the center of the pipe element bore to the floor of the groove) within a desired tolerance range. Additionally, impressing a circumferential groove near the end of a pipe element often causes the end region of the pipe element to expand in diameter, a phenomenon known as "flare". Flare and pipe element tolerances must be accounted for in the design of mechanical couplings and seals and this complicates their design and manufacture. These considerations have resulted in complicated prior art devices which, for example, require actuators for forcing the rollers into engagement with the pipe element and the need for the operator to adjust the roller travel to achieve the desired groove radius. Additionally, prior art roll grooving machines apply significant torque to the pipe element and have low production rates, often requiring many revolutions of the pipe element to achieve a finished circumferential groove. There is clearly a need for devices, for example, those using cams, to accurately cold work pipe elements which are simple yet produce faster results with less operator involvement.

SUMMARY

The invention concerns a device for forming a circumferential groove in a pipe element. In an example embodiment the device comprises a pinion fixed against rotation about a pinion axis arranged coaxially with the pinion. A carriage surrounds the pinion. The carriage is rotatable about the pinion axis and defines an opening arranged coaxially with the pinion axis for receiving the pipe element. A cup is positioned adjacent to the pinion. The cup has a sidewall arranged coaxially with the pinion axis which defines an interior. The sidewall has an inner surface. The inner surface has a first diameter located distal to the pinion and a second diameter located proximate to the pinion. The first diameter is larger than the second diameter. In a specific example embodiment the sidewall may have a conical inner surface. In an example embodiment the conical inner surface may define an included angle from 11° to 16°.

The interior faces the opening for receiving the pipe element. The cup is movable along the pinion axis toward and away from the pinion. A pipe end stop is positioned within the interior between the first and second diameters. The pipe end stop is movable along the pinion axis toward and away from the pinion relatively to the cup. A cup spring may act between the cup and the pinion to bias the cup away from the pinion. A stop spring may act on the pipe end stop and to bias the pipe end stop away from the pinion. A plurality of gears are mounted on the carriage. Each gear is rotatable relatively to the carriage about a respective gear axis. At least one of the gears engages directly with the pinion. In an example embodiment, each gear engages directly with the pinion. A plurality of cam bodies are mounted on a respective one of the gears. A plurality of first cam surfaces extend around a respective one of the cam bodies and are engageable with the pipe element received within the opening. Each one of the first cam surfaces comprises a region of increasing radius. Each one of the first cam surfaces comprises a first discontinuity of the first cam surface.

An example device according to the invention may further comprise a pinion shaft. The pinion is fixedly mounted on the pinion shaft. The carriage is rotatably mounted on the pinion shaft. In an example embodiment the pinion shaft defines a bore coaxially aligned with the pinion axis. A cup shaft may be positioned within the bore. The cup shaft is movable along the pinion axis within the bore. A first end of the cup shaft projects from the bore. The cup is mounted proximate to the first end of the cup shaft. In an example embodiment the cup comprises a hub which coaxially receives the cup shaft. A back wall extends outwardly from the hub. The sidewall is attached to the back wall.

In an example device according to the invention the pipe end stop comprises a sleeve fixedly mounted on the cup shaft. A plate, mounted on the sleeve, extends outwardly therefrom. The plate defines a pipe engaging surface facing the opening. By way of example the plate may further comprise a reverse cone surface positioned within the pipe engagement surface.

In a further example the cup may comprise a hub which coaxially receives the sleeve. A back wall extends outwardly from the hub. The sidewall is attached to the back wall. An example device may further comprise a base and a post mounted on the base. The pinion shaft may be fixedly mounted on the post. In an example embodiment the cup spring comprises a conical spring.

Further by way of example, each gear has a same pitch circle diameter. Also by way of example, each one of the first cam surfaces may comprise a region of constant radius positioned adjacent to a respective one of the first discontinuities. In a specific example embodiment, each one of the second cam surfaces comprises a region of constant radius positioned adjacent to a respective one of the second discontinuities. Further by way of example, each one of the second cam surfaces may have a constant radius.

In an example embodiment, at least one traction surface extends around one of the cam bodies. The at least one traction surface has a gap therein. The gap is aligned axially with the first discontinuity of the first cam surface surrounding the one cam body. In a specific example embodiment, the at least one traction surface comprises a plurality of projections extending outwardly therefrom. By way of further example, the at least one traction surface is positioned proximate to the first cam surface surrounding the one cam body.

In an example embodiment the pinion has a pitch circle diameter equal to an outer diameter of the pipe element. In a further example embodiment, the at least one traction surface has a pitch circle diameter equal to a pitch circle diameter of one of the gears.

An example device according to the invention may further comprise a plurality of the traction surfaces. Each one of the traction surfaces extends around a respective one of the cam bodies. Each one of the traction surfaces has a gap therein. Each gap is aligned axially with a respective one of the discontinuities of the first cam surfaces on each one of the cam bodies. Each one of the traction surfaces having a pitch circle diameter equal to the pitch circle diameters of the gears. In an example embodiment at least one traction surface extends around one of the cam bodies. The at least one traction surface has a gap therein. The gap is aligned axially with the first discontinuity of the first cam surface surrounding the one cam body. An example embodiment may have a first cam surface positioned between the at least one traction surface and the second cam surface surrounding the one cam body. Further by way of example, the first and second cam surfaces may be positioned between the at least one traction surface and the gear on which the one cam body is mounted.

An example embodiment may further comprise a plurality of the traction surfaces. Each one of the traction surfaces extends around a respective one of the cam bodies. Each one of the traction surfaces has a gap therein. Each the gap is aligned axially with a respective one of the discontinuities of the first cam surfaces on each one of the cam bodies. Each one of the traction surfaces may have a pitch circle diameter equal to the pitch circle diameters of the gears. Further by way of example each one of the first cam surfaces may be positioned between a respective one of the traction surfaces and a respective one of the second cam surfaces on each the cam body. In another example embodiment, each one of the first and second cam surfaces may be positioned between the respective one of the traction surface and a respective one of the gears on each the cam body. In a specific example, each one of the first cam surfaces is positioned proximate to a respective one of the traction surfaces on each the cam body. An example embodiment of a device according to the invention may comprise at least three the gears or at least five the gears.

BRIEF DESCRIPTION OF THE DRAWINGS

FIG. 1 is a longitudinal sectional view of an example device for forming circumferential grooves in pipe elements;

DETAILED DESCRIPTION

Figure 1A:
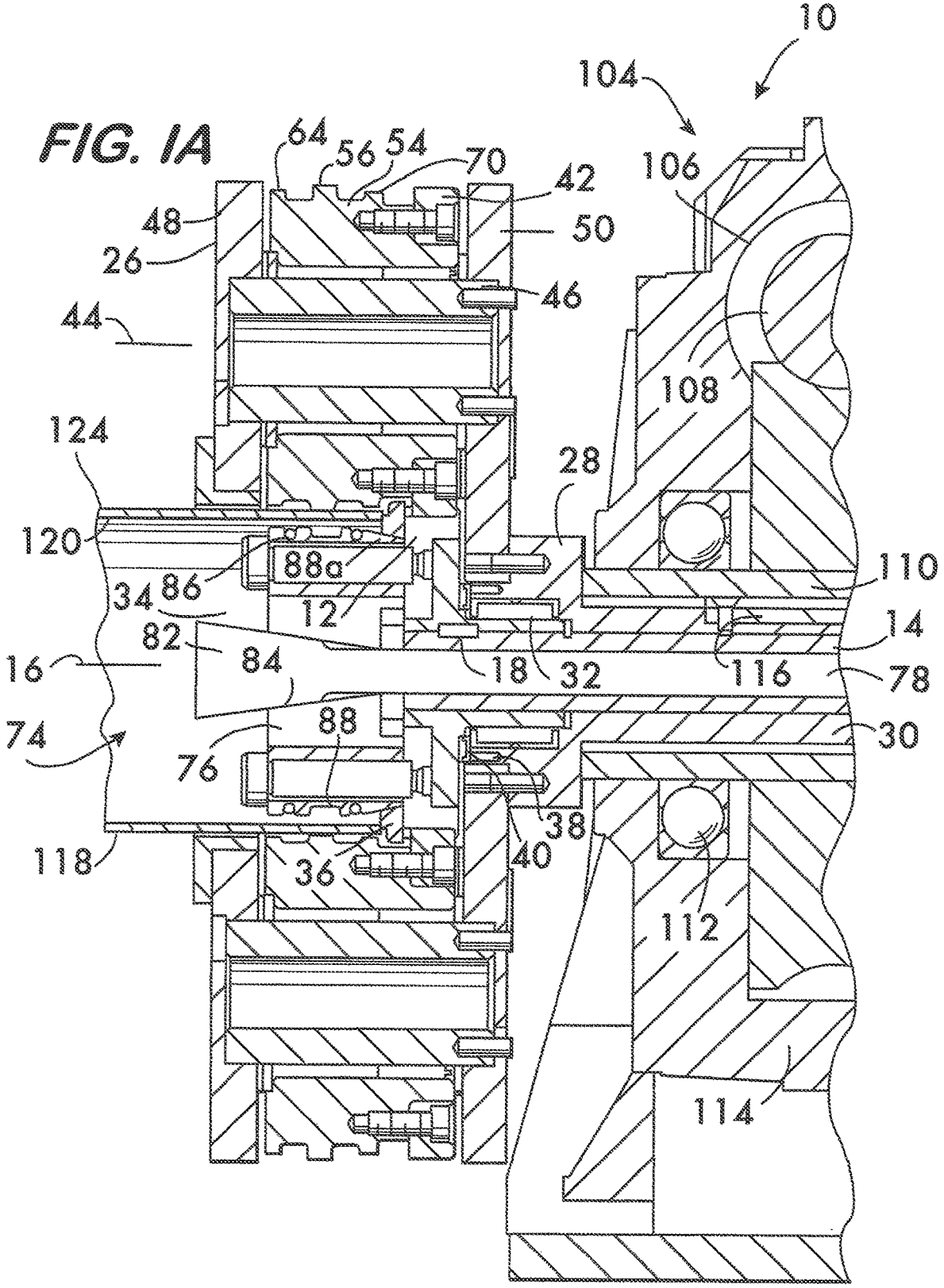
FIG. 1A is a longitudinal sectional view on an enlarged scale of a portion of the device shown in FIG. 1.

FIGS. 1 and 1A show an example device 10 for forming a circumferential groove in a pipe element. Device 10 is advantageous for grooving pipe elements having nominal diameters of 1.25 inches or greater. Device 10 comprises a pinion 12 mounted on an intermediate shaft 14 (see also FIG. 3). Pinion 12 and intermediate shaft 14 are fixedly mounted against rotation about a pinion axis 16 arranged coaxially with the pinion and shaft. Rotational fixity of the pinion 12 is accomplished using a key 18 between the pinion and the intermediate shaft 14 as well as engaging a portion 14*a* of the intermediate shaft 14 with a fixing mount 20. The fixing mount 20 is fixedly mounted on a base 22. Portion 14*a* of intermediate shaft 14 has a polygonal cross section which engages an opening 24 which extends through the fixing mount 20. The shape of opening 24 is matched to that of portion 14*a* of the intermediate shaft 14 and will thus prevent rotation of the shaft about the pinion axis 16 but allow axial motion of the shaft. In this example embodiment, portion 14*a* has a square cross section and opening 24 has a substantially matching square shape.

A carriage 26 surrounds the pinion 12. Carriage 26 is mounted on the flange 28 of an outer shaft 30. Outer shaft 30 is hollow, surrounds and is coaxial with the intermediate shaft 14. Bearings 32 positioned between the outer shaft 30 and the intermediate shaft 14 permit the outer shaft, and hence the carriage 26 attached thereto, to rotate about the pinion axis 16 relatively to intermediate shaft 14. The carriage 26 defines an opening 34 for receiving a pipe element in which a groove is to be formed. Opening 34 is arranged coaxially with the pinion axis 16. A stop plate 36 is mounted on the intermediate shaft 14 via the pinion 12. Stop plate 36 is movable axially along pinion axis 16 with the intermediate shaft 14 and the pinion 12. The stop plate 36, intermediate shaft 14 and pinion 12 are biased toward the opening 34 by springs 38 acting between the pinion and the outer shaft 30 via the shaft flange 28. Because intermediate shaft 14 is fixed in rotation relatively to the base 22, thrust bearings 40 may be used between pinion 12 and springs 40 to protect the springs 38 which rotate with the flange 28 and the outer shaft 30, and reduce friction between the pinion 12 and the flange 28. The stop plate 36 cooperates with pinion 12 and thrust bearings 40 to provide a positive stop which locates the pipe element for proper positioning of the groove.

A plurality of gears 42 are mounted on the carriage 26. In the example embodiment shown in FIGS. 1, 2 and 3, the carriage has 4 gears spaced at angles of 90° from one another. Each gear 42 is rotatable about a respective gear axis 44. In a practical embodiment, each gear is mounted on a gear shaft 46 fixed between front and rear plates 48 and 50 comprising the carriage 26. Bearings 52 positioned between each gear 42 and its respective shaft 46 provide for low friction rotation of the gears within the carriage 26. Each gear 42 engages with the pinion 12.

Figure 3:
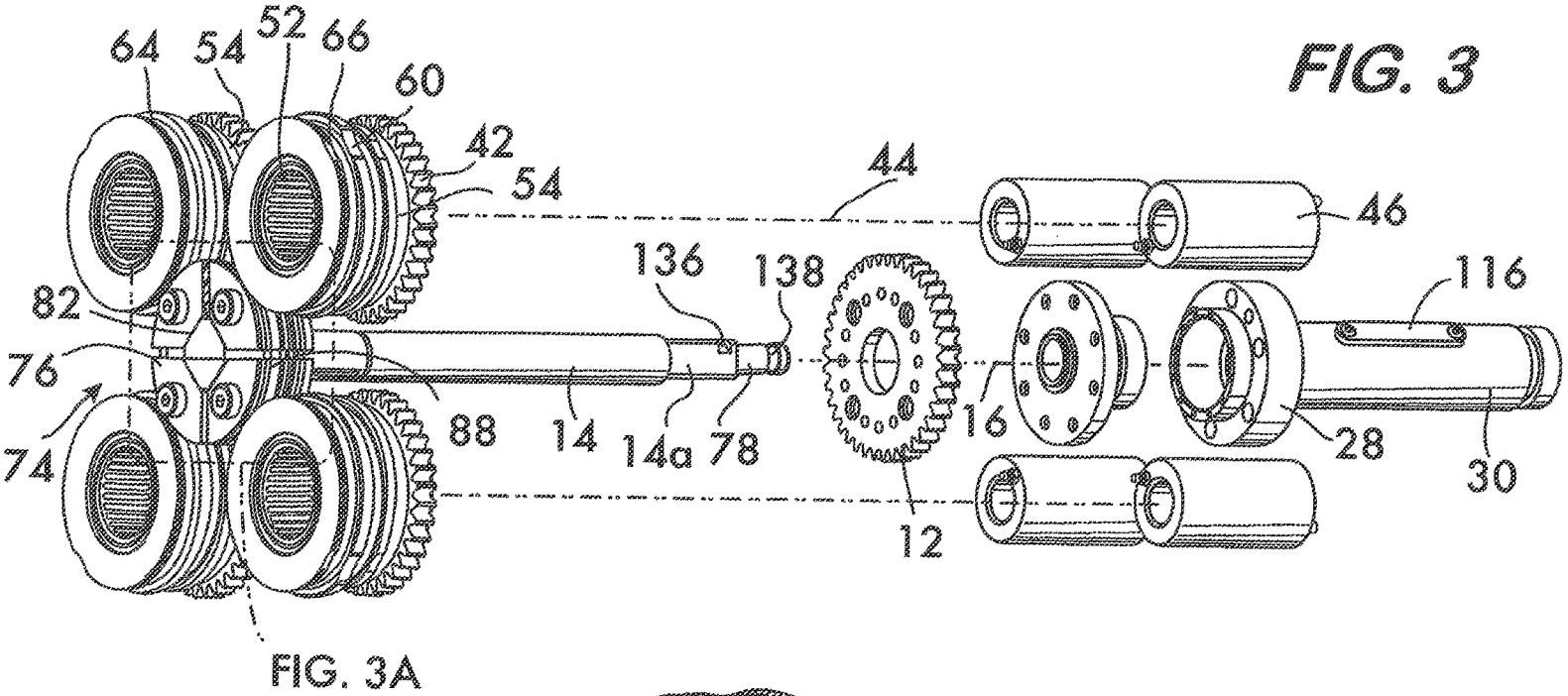
FIGS. 3 and 3A are exploded isometric views of selected components of the device shown in FIG. 1.
Figure 4:
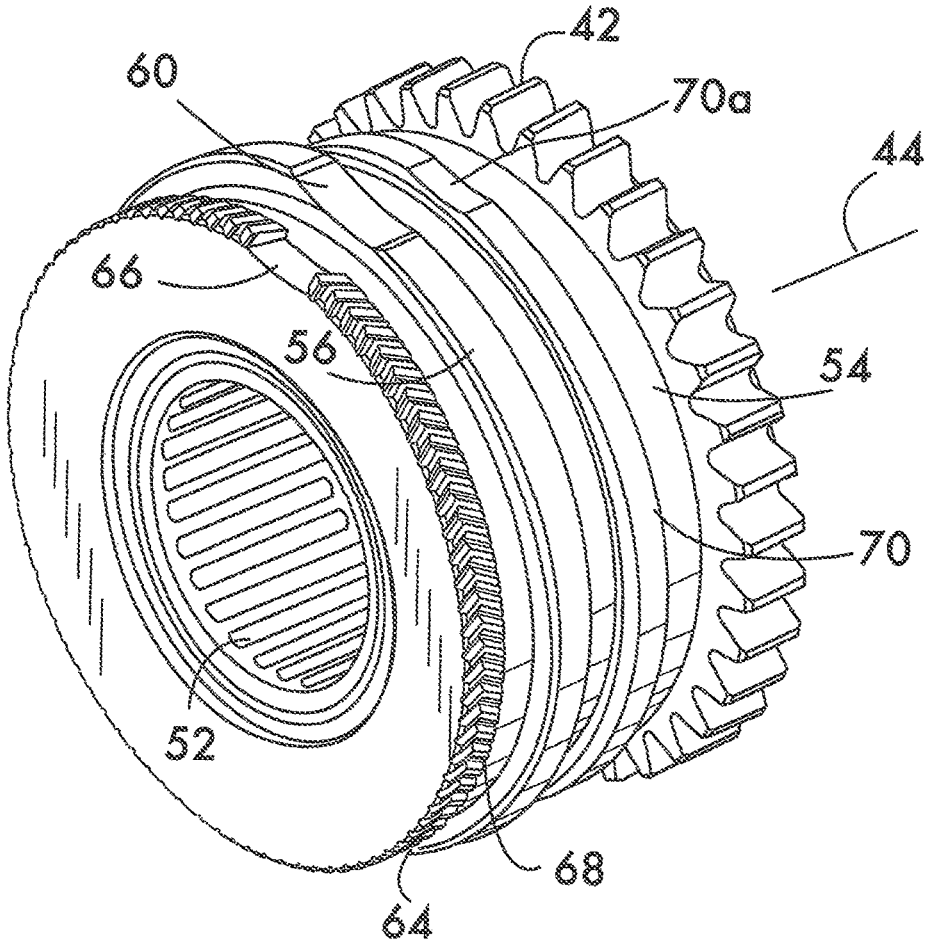
FIG. 4 is an isometric view of an example cam used in the device shown in FIG. 1 on an enlarged scale.
Figure 5:
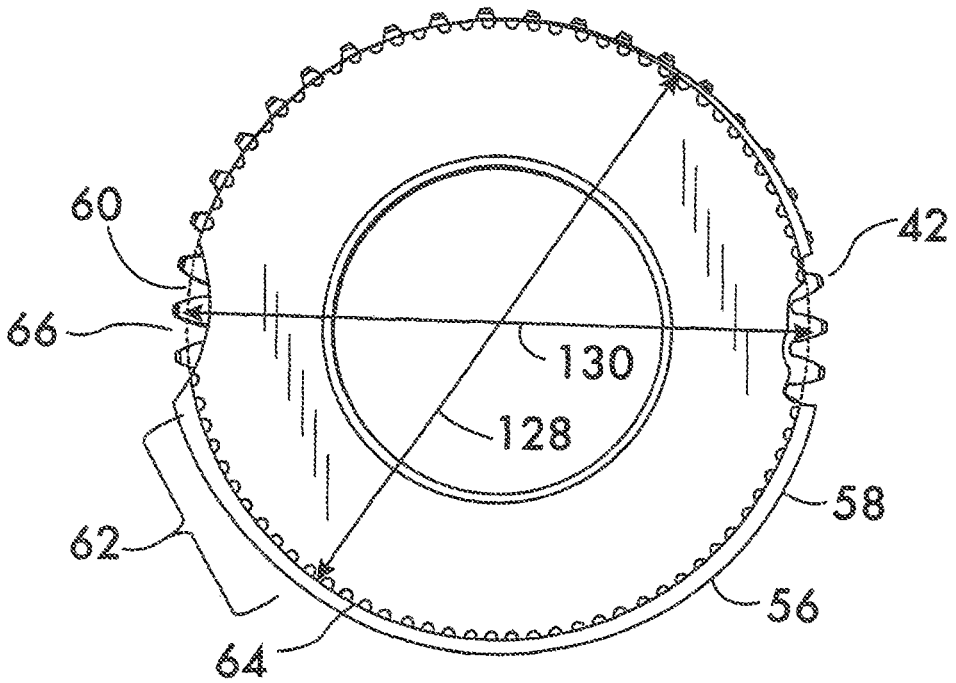
FIG. 5 is an end view of an example cam used in the device shown in FIG. 1 on an enlarged scale.

As shown in FIG. 4, a cam body 54 is mounted on each gear 42. A first cam surface 56 extends around each cam body 54. First cam surfaces 56 are engageable with the pipe element received through the opening 34. As shown in FIG. 5, first cam surface 56 comprises a region of increasing radius 58 and a discontinuity 60 of the cam surface. Discontinuity 60 is a position on the cam body 54 where the cam surface 56 does not contact the pipe element. It is further advantageous to include, as part of each first cam surface 56, a region of constant radius 62 positioned adjacent to the discontinuity 60. At least one traction surface 64 may extend around one of the cam bodies 54. In the example shown in FIG. 3, a respective traction surface 64 extends around each cam body 54. The traction surfaces 64 are also engageable with a pipe element received within the carriage 26, but each traction surface has a gap 66 aligned axially (i.e., in a direction along the gear axis 44) with the discontinuity 60 in the first cam surface 56 on each cam body 54. As shown in FIG. 4, the traction surface 64 may comprise a plurality of projections 68 extending outwardly therefrom. The projections provide purchase between the pipe element and the traction surface 64 during device operation and may be formed, for example, by knurling the traction surface. The traction surface has pitch circle with a diameter 128. When projections 68 are present on traction surface 64, pitch diameter 128 of the traction surface will be determined by the interaction of projections 68 with pipe element 79, including the impression made by the projections 68 upon pipe element 79. If projections 68 are not present, the pitch circle diameter 127 of the traction surface 64 will equal that of the traction surface. As further shown in FIG. 4, the first cam surface 56 is positioned between the gear 42 and the traction surface 64, in spaced relation to the traction surface but proximate to it as compared with the gear.

Figure 6:
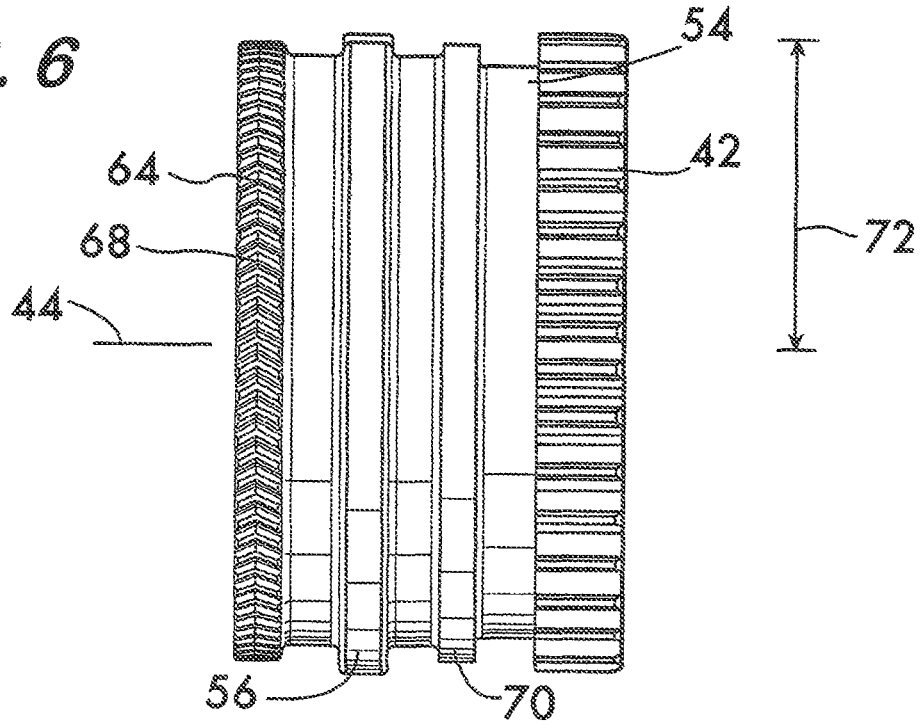
FIG. 6 is a side view of an example cam used in the device shown in FIG. 1 on an enlarged scale.

As shown in FIGS. 1 and 4, a second cam surface 70 is also positioned on the cam body 54 and extends there around. Second cam surface 70 is a controlled flare surface. Flare is the radial expansion of the pipe element's end which tends to occur when a circumferential groove is formed near that end. The second cam surface 70 (controlled flare surface) is positioned adjacent to the gear 42 so that it contacts the pipe element near its end where flare would be most pronounced as a result of groove formation. As shown in FIGS. 4 and 6, except for its discontinuity 70*a*, the second cam surface 70 has a constant radius 72 sized to engage the pipe element to control the flare and, for example, maintain its end at the pipe element's original nominal diameter during and after groove formation. Discontinuity 70*a* is aligned with the discontinuity 60 in the first cam surface 56 and is a position on the cam body 54 where the cam surface 70 does not contact the pipe element. In alternate embodiments, the second cam surface 70 may have a region of increasing radius and a finishing region of constant radius, or second cam surface 70 may have an increasing radius over its entire arc length.

Figures 2, 2A:
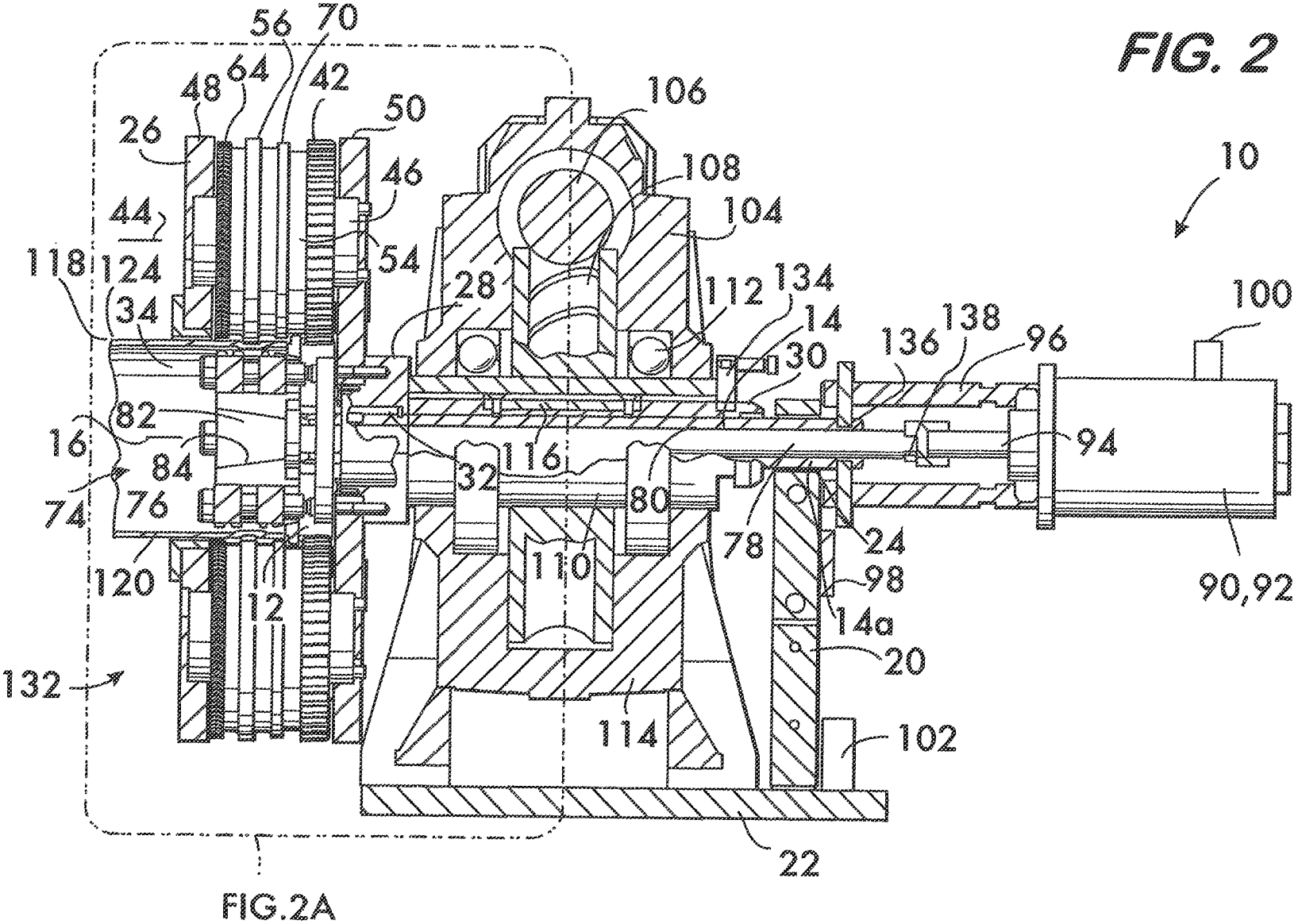
FIG. 2 is a longitudinal sectional view of the device shown in FIG. 1 forming a circumferential groove in a pipe element.
FIG. 2A is a longitudinal sectional view on an enlarged scale of a portion of the device shown in FIG. 2.
Figure 2A:
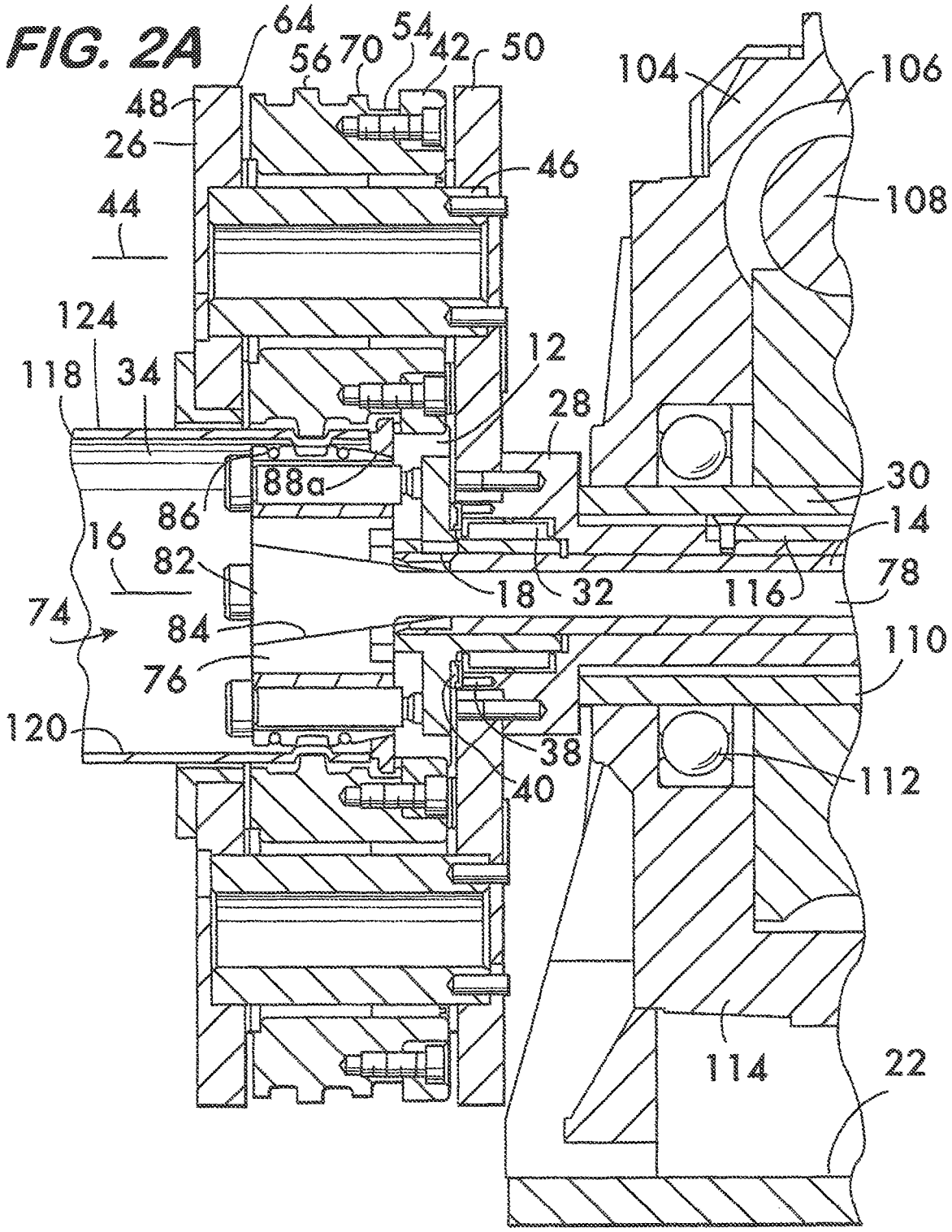
Figure 3A:
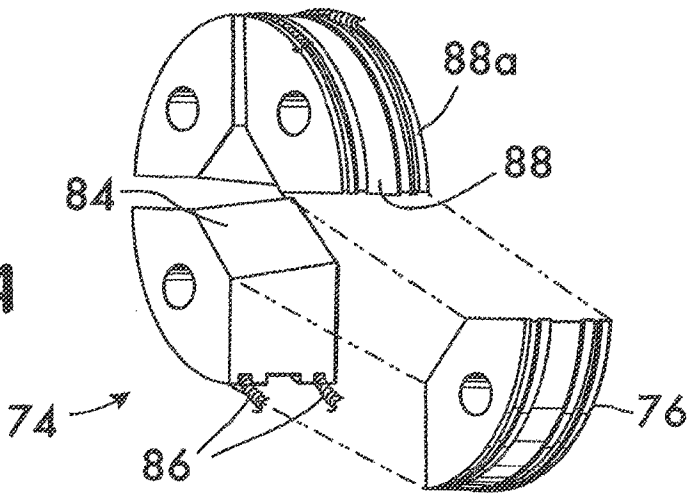

As shown in FIGS. 1, 3 and 3A, device 10 further comprises an expanding die 74 positioned adjacent to the pinion 12. In this example die 74 comprises four segments 76 radially slidably mounted on pinion 12 and coupled to an actuator. In this example, the actuator comprises a draw bar 78 which extends through a hollow bore 80 of the intermediate shaft 14. The draw bar 78 has a tapered, faceted end 82 which engages mating facet surfaces 84 on each die segment 76. Draw bar 78 is movable axially within bore 80 relatively to the intermediate shaft 14 and die segments 76 are movable radially toward and away from the pinion axis 16 relatively to the pinion 12. Radial motion of the die segments 76 is effected by axial motion of the draw bar 78. FIGS. 1 and 1A illustrate the draw bar 78 and die segments 76 in the retracted position and FIGS. 2 and 2A illustrate the draw bar and die segments in the expanded position. When the draw bar 78 is extended toward the opening 34 of carriage 26 (FIGS. 1, 1A) the die segments 76 are positioned on the smaller part of the tapered end 82 of the draw bar 78 and the die segments are in their retracted position. Die 74 further comprises circular springs 86 (see FIG. 3A) which surround and bias the die segments 76 into the retracted position. When the draw bar 78 is drawn away from the opening 34 of carriage 26 (FIGS. 2, 2A) the die segments 76, being axially fixed on pinion 12, are forced radially outwardly through interaction between the facet surfaces 84 on each segment 76 and the tapered, faceted end 82 of the draw bar 78. When the draw bar 78 is returned toward the opening 34 of carriage 26, the die segments 76 travel radially inwardly under the influence of circular springs 86 and return to the retracted position.

As further shown in FIGS. 1A and 3A, each die segment 76 has a die face 88 which faces radially away from the pinion axis 16 so as to engage the inner surface of a pipe element received within the carriage 26. Die faces 88 have a profile shape which is coordinated with the shape of the first cam surfaces 56 on the cam bodies 54. As described below, the first cam surfaces 56 and the die faces 88 cooperate to form a circumferential groove of a desired shape in the pipe element (see FIGS. 2, 2A). For pipe elements having a nominal diameter of 1.25 inches or greater it may be advantageous to use the die 74 in conjunction with first cam surfaces 56 to more precisely control the final groove shape and dimensions of the pipe element. Use of the die 74 is expected to produce better defined circumferential grooves than is possible using cam surfaces alone. Note that die faces 88 have a tapered surface 88*a* (FIGS. 1A, 2A and 3A) which provides free space for the second (controlled flare) cam surfaces 70 to form the end of the pipe element when it is greater than nominal diameter. Surfaces 88*a* are also useful when controlled flare surfaces 70 are used to reduce the outer diameter of the pipe element.

As shown in FIGS. 1 and 2, the actuator which moves draw bar 78 axially to expand and retract die 74 further comprises a cylinder and piston 90. In this example embodiment, cylinder and piston 90 comprises a double acting pneumatic cylinder 92 having a piston 94 coupled to the draw bar 78. Pneumatic cylinder 92 is mounted on a frame 96 which is attached to the intermediate shaft 14 and is movable relatively to the base 22. Thus, the pneumatic cylinder 92 moves axially with the intermediate shaft 14 but its piston 94 can move the draw bar 78 relatively to the intermediate shaft 14. A position sensor 98 is used to detect the position of the assembly which includes the draw bar 78, the die 74, the pinion 12, the intermediate shaft 14 and the pneumatic cylinder 92 and its frame 96. The position sensor 98 may for example, comprise a proximity sensor or a micro switch. A pressure sensor 100 is used to detect the pressure status of the pneumatic cylinder 92. Both the position sensor 98 and the pressure sensor 100 are in communication with a controller 102, which may comprise, for example a programmable logic controller or other microprocessor. The controller 102 uses information from the position sensor 98 and the pressure sensor 100 to control operation of the device 10 as described below.

Figure 7:
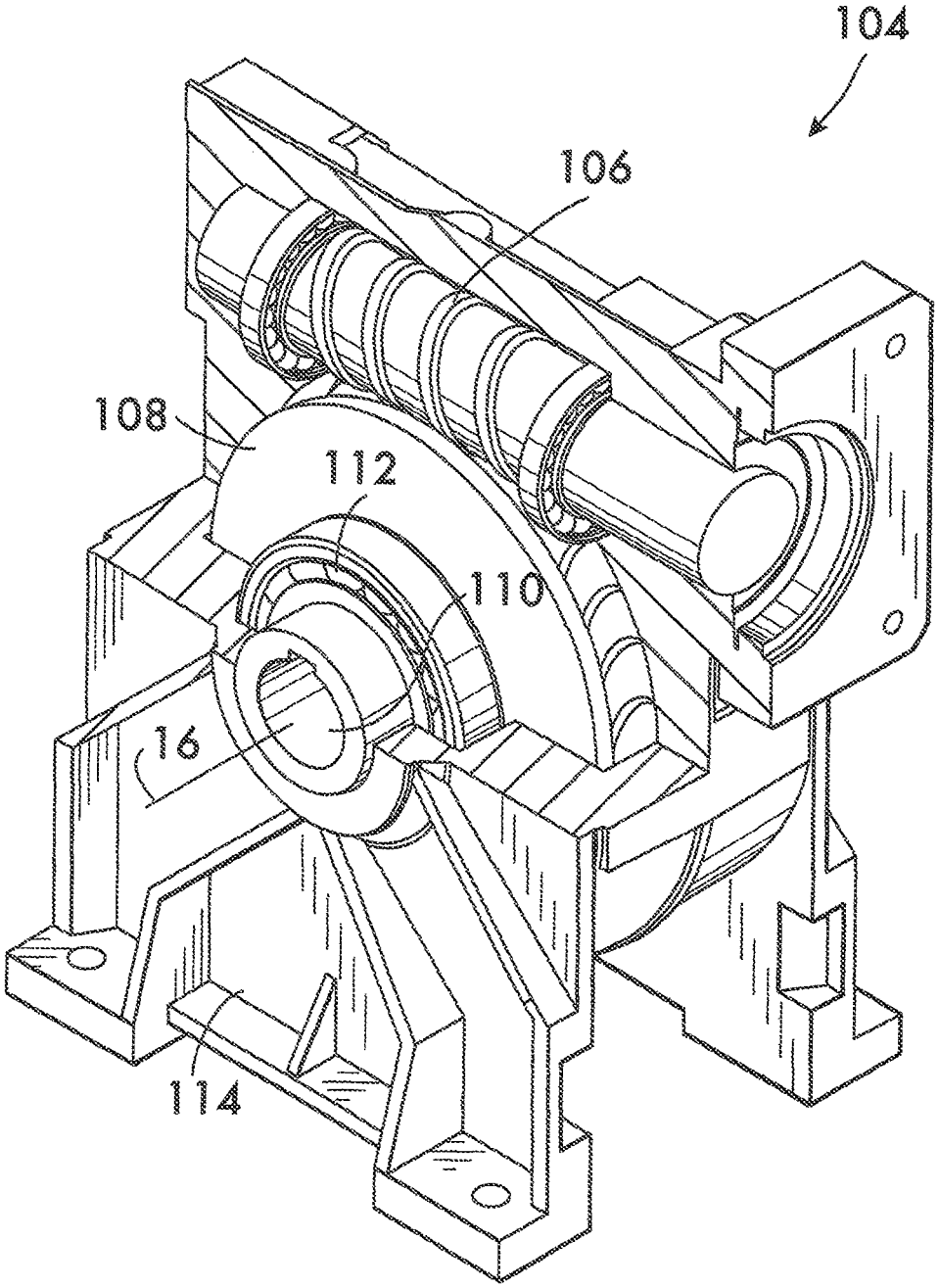
FIG. 7 is an isometric view of a gear reduction assembly used in the device shown in FIG. 1.

As shown in FIGS. 1 and 7, a reducing gear train 104 is used to rotate the outer shaft 30 about the pinion axis 16. In this example embodiment the reducing gear train 104 comprises a worm screw 106 driven by a servo motor (not shown) controlled by controller 102. The servo motor acts as an indexing drive and has an encoder which provides precise information as to the position of the motor shaft, thereby allowing precise control of the rotation of the worm screw 106.

Worm screw 106 meshes with a worm wheel 108. As shown in FIGS. 1 and 7 the worm wheel 108 is mounted on an output shaft 110 supported for rotation about the pinion axis 16 on bearings 112 between the output shaft 110 and a gearbox 114, which is fixed to the base 22. Output shaft 110 is coupled to the outer shaft 30 by a key 116, thus ensuring rotation of the outer shaft 30 when the output shaft 110 is rotated by the worm screw 106 and worm wheel 108.

Figure 8:
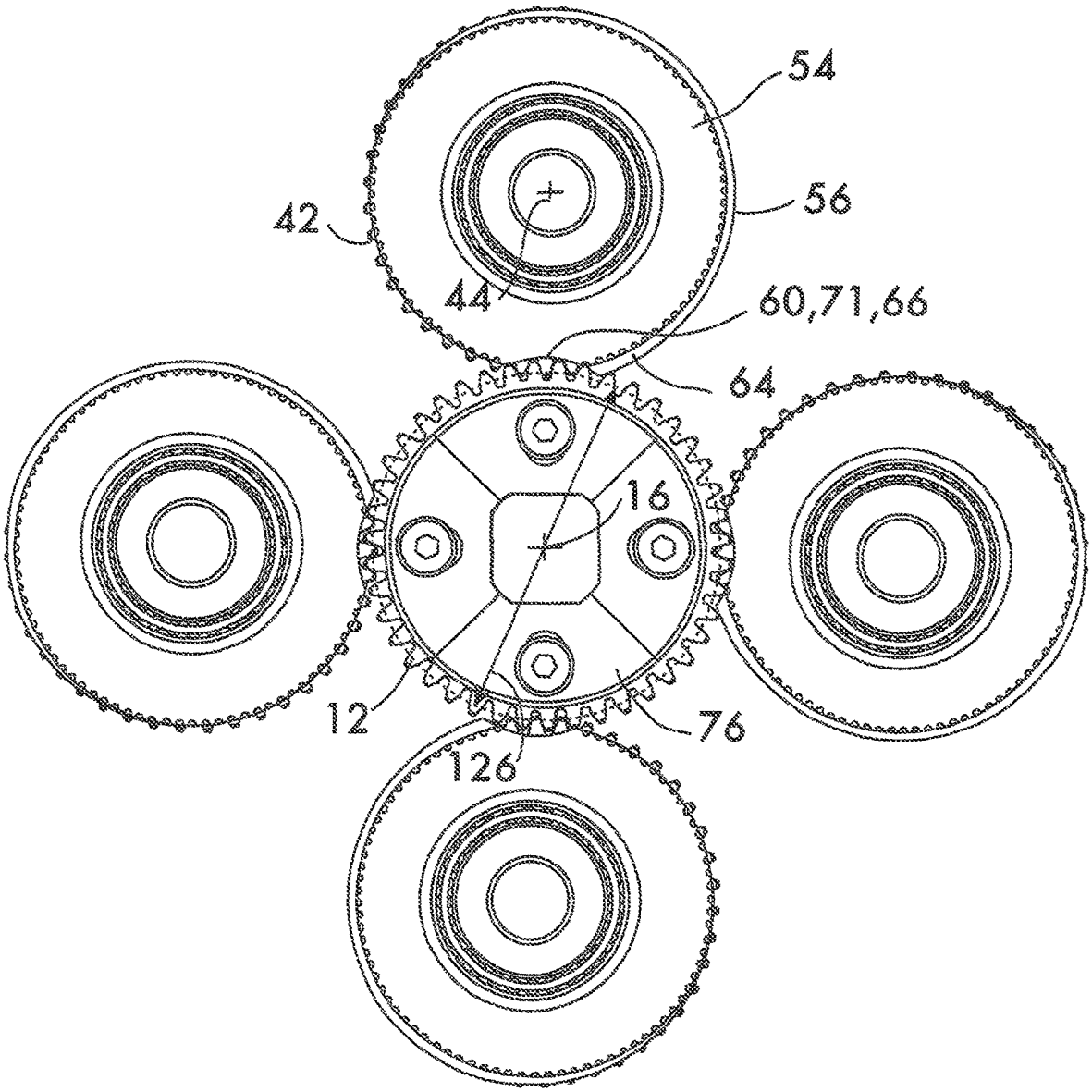
FIG. 8 is an end view of selected components used in the device shown in FIG. 1.

Operation of device 10 begins with the cam bodies 54 positioned as shown in FIG. 8, with the discontinuities 60 and 70*a* in their respective first and second cam surfaces 56 and 70 (not visible) facing the pinion axis 16 and the gaps 66 in their respective traction surfaces 64 (when present) also facing pinion axis 16. This orientation of the cam bodies 54 is established upon assembly of the gears 42 with the pinion 12 in the carriage 26 and is set as the start position by the controller 102 (FIG. 1) and the servo motor (not shown) acting through the worm screw 106 and worm wheel 108. Die segments 76 are in their retracted position (FIG. 1A).

As shown in FIGS. 1 and 1A, with the cam bodies 54 in the start position and the die segments 76 retracted, a pipe element 118 to be grooved is inserted through opening 34 in carriage 26 and against the stop plate 36. The alignment of the gaps 66 in the traction surfaces 64 (when present) and the respective discontinuities 60, 70*a* in the first and second cam surfaces 56, 70 as well as the retracted position of the die segments 76 provide clearance for pipe insertion. The pipe element 118 is further pressed against stop plate 36, compressing the springs 38 and moving the assembly comprising the die 74, the pinion 12, the draw bar 78, thrust bearing 40 and the pneumatic cylinder 92 axially relatively to the base 22 and the fixing mount 20 attached thereto, thereby reaching the positive stop state when thrust bearing 40 abuts flange 28. The position of the assembly is sensed by the position sensor 98 which sends a signal indicative of the assembly position to the controller 102. Upon receipt of the position signal, controller 102 commands the pneumatic cylinder 92 to pull the draw bar 78 away from the opening 34 of the carriage 26. This causes the die segments 76 to move radially outward into an expanded position (FIGS. 2, 2A) and thereby engage the die faces 88 with the inner surface 120 of the pipe element 118. The expanded position of the die segments 76 will vary depending upon the inner diameter of the pipe element. Pneumatic cylinder 92 maintains force on draw bar 78, thereby locking the dies 76 against the pipe element inner surface. When the pressure sensor 100 senses a threshold lower pressure on the retract side of the pneumatic cylinder 92 indicating that the draw bar 78 has been pulled, it sends a signal to the controller 102 indicative of the status of the die segments 76 as expanded. Upon receipt of the die status signal from the pressure sensor 100 the controller 102 commands the servo motor to turn the worm screw 106, which turns the worm wheel 108. In this example rotation of the worm wheel 108 rotates the output shaft 110 counterclockwise (when viewed in FIG. 8) which causes the outer shaft 30 to which it is keyed (key 116, see FIG. 2A) to rotate. Rotation of outer shaft 30 rotates carriage 26 counterclockwise about the pinion axis 16. (The direction of rotation of carriage 26 is predetermined by the arrangement of the first cam surfaces 56 on the cam bodies 54.) This causes the gears 42 and their associated cam bodies 54 to orbit about the pinion axis 16. However, the pinion 12 is fixed against rotation because the intermediate shaft 14 is locked to fixing mount 20 by the interaction between intermediate shaft portion 14*a* and opening 24 of the fixing mount. Because the gears 42 engage the (fixed) pinion 12, relative rotation of the carriage 26 about the pinion axis 16 causes the gears 42, and their associated cam bodies 54, to rotate about their respective gear axes 44 (see FIGS. 2, 2A and 8). Rotation of the cam bodies 54 brings traction surfaces 64 and first cam surfaces 56 into contact with the outer surface 124 of the pipe element 118. The traction surfaces 64 grip the pipe element while the first cam surfaces 56 impress a groove into the pipe element outer surface 124 as the region of increasing radius 58 and the region of constant radius 62 of each first cam surface 56 traverse the pipe element 118. The die segments 76 are engaged and support the inner surface 120 of the pipe element 118 and the die faces 88 cooperate with the first cam surfaces 56 to form the circumferential groove.

The location of the first cam surfaces 56 and the second (controlled flare) cam surfaces 70 on the cam bodes 54 are coordinated with the position of the pipe element 118 received within the carriage 26 so that the groove is formed at the desired distance from the end of the pipe element 118 and the flare at the end of the pipe element is controlled, i.e., limited or reduced to approximately its nominal diameter or smaller. The controller 102 rotates the carriage 26 through as many revolutions as necessary (depending upon the gear ratio between the gears 42 and the pinion 12) to form a circumferential groove of substantially constant depth for pipe elements having uniform wall thickness. In this example embodiment only one revolution of the carriage is necessary to form a complete circumferential groove of constant depth. Upon completion of groove formation the controller 102, acting though the servo motor and gear train 104 returns the carriage 26 to a position where gaps 66 in the traction surfaces 64 and the discontinuities 60 and 70*a* in the first and second cam surfaces 56 and 70 again face the pinion axis 16 (FIG. 8). The controller 102 then commands the pneumatic cylinder 92 to move the draw bar 78 toward the opening 34 and allow the die segments 76 to move radially inward to their retracted position and disengage from the pipe element 118 under the biasing force of the circular springs 86 (FIGS. 1 and 3A). This position of the cam bodies 54 and die 74 allows the pipe element 118 to be withdrawn from the carriage 26. As the pipe element 118 is withdrawn, springs 38 push the assembly comprising the draw bar 78, pinion 12, thrust bearing 40, intermediate shaft 14, pneumatic cylinder 92 and die 74 back to its initial position and device 10 is again ready to groove another pipe element.

Significant advantage is achieved with the device 10 because it applies minimal torque to the pipe element during the grooving process while forming a groove to a fixed diameter. As shown in FIGS. 8 and 5, this condition is achieved when: 1) the pitch circle diameter 126 of pinion 12 is substantially equal to the outer diameter of the pipe element (FIG. 8); and, 2) the pitch circle diameter 128 of the traction surfaces 64 is substantially equal to the pitch circle diameter 130 of the gears 42 (FIG. 5). When these two conditions are met, the traction surfaces 64 are constrained to traverse the outer surface of the pipe element with little or no tendency to cause the pipe to rotate, and thus apply only minimal torque to the pipe element. The terms "equal" and "substantially equal" as used herein to refer to the relationship between the pitch circle diameters of pinions, gears and the traction surfaces and the outer diameter of the pipe element means that the pitch circle diameter of the pinion is close enough to the outer diameter of the pipe element and the pitch circle diameter of the traction surface is close enough to the pitch circle diameter of the gears such that minimal torque is applied to the pipe element. The pitch circle diameter of the pinion may be considered "equal to" or "substantially equal to" the outer diameter of the pipe element for practical purposes if the difference between these values is on the order of hundredths of an inch. Because practical pipes have significant diametral tolerances from nominal, it is expected that the relationship between the pitch circle diameter of the traction surfaces and the outer diameter of the pipe element may be affected by pipe diameter deviation such that torque will be applied to the pipe element, thereby making the use of an external clamp advantageous in those cases. In device 10, die 74 may act as a clamp as it is mounted on the pinion 12, which is fixed in rotation.

In a practical example design, a device 10 suitable for grooving pipe elements having a nominal pipe size of 2.5 inches uses four gears 42 and cam bodies 54 as shown. The outer diameter of 2.5 inch nominal pipe is 2.875 inches. A pinion 12 having 36 teeth and a pitch circle diameter of 72 mm (2.835 inches) is close enough (a difference of 0.040 inches) such that minimal torque is applied when the pitch circle diameters of the gears and the pitch circle diameter of the traction surfaces are also substantially equal to one another. This example embodiment uses gears 42 having 36 teeth with a pitch circle diameter of 72 mm (2.835 inches). The traction surfaces 64, when knurled or otherwise prepared, although not a gear, have a substantially equivalent pitch diameter (i.e., the diameter of a cylinder which gives the same motion as an actual gear), which is impressed into the pipe as it is traversed by the traction surface. Differences between the pitch circle diameter of the traction surfaces and the pitch circle diameter of the gears on the order of hundredths of an inch fulfill this definition of "equal" or "equivalent" in practical applications. Considering the gear ratio between the pinion 12 and the gears 42 are equal in this example, it is clear that the carriage 26 will make one revolution to form a complete circumferential groove about the pipe element.

In another example design suitable for 4 inch nominal size pipe having an outer diameter of 4.5 inches, a pinion having 72 teeth with a pitch circle diameter of 4.5 inches is feasible. This design uses 4 gears, each gear having 72 teeth and a pitch circle diameter of 4.5 inches. The 1:1 ratio between pinion and gear indicate a single carriage revolution is required to form a complete groove. Other ratios between pinion and gear will result in multiple or partial carriage revolutions to form a complete groove.

Device 10 is designed such that the carriage 26 and its associated gears 42, cam bodies 54, pinion 12, outer shaft 30, intermediate shaft 14 and die 74 along with other related components constitute an assembly 132 interchangeable with the gear train 104 to permit the device to be readily adapted to groove a range of pipes having different diameters and wall thicknesses. Interchangeability is afforded by the use of a removable clip 134 to secure the outer shaft 30 to the gear box 114 and the key 116 between the outer shaft 30 and the output shaft 110 of worm wheel 108 as well as attaching the intermediate shaft 14 to the frame 96 of the pneumatic cylinder 92 by engaging the frame with slots 136 in the intermediate shaft and attaching the piston 94 to the draw bar 78 also using mutually engaging slots and shoulders 138. The assembly 132 can be removed by lifting the pneumatic cylinder 92 so that the frame 96 disengages from the intermediate shaft 14 and the piston 94 disengages from the draw bar 78, and then removing the retaining clip 34 (thereby allowing the outer shaft 30 to disengage from the worm wheel 108) and sliding the assembly along the pinion axis 16. A different carriage assembly, suitable for grooving a different pipe element, may then be substituted.

Devices 10 according to the invention are expected to increase the efficiency of pipe grooving operations because they will operate rapidly and accurately on a wide range of pipe element sizes and schedules without the need for stands to both support the pipe element and accommodate its rotation and ensure alignment. Device 10 will also permit bent pipe elements and pipe assemblies having elbow joints to be grooved without concern for rotation of the transverse pipe element's motion.

Figure 9:
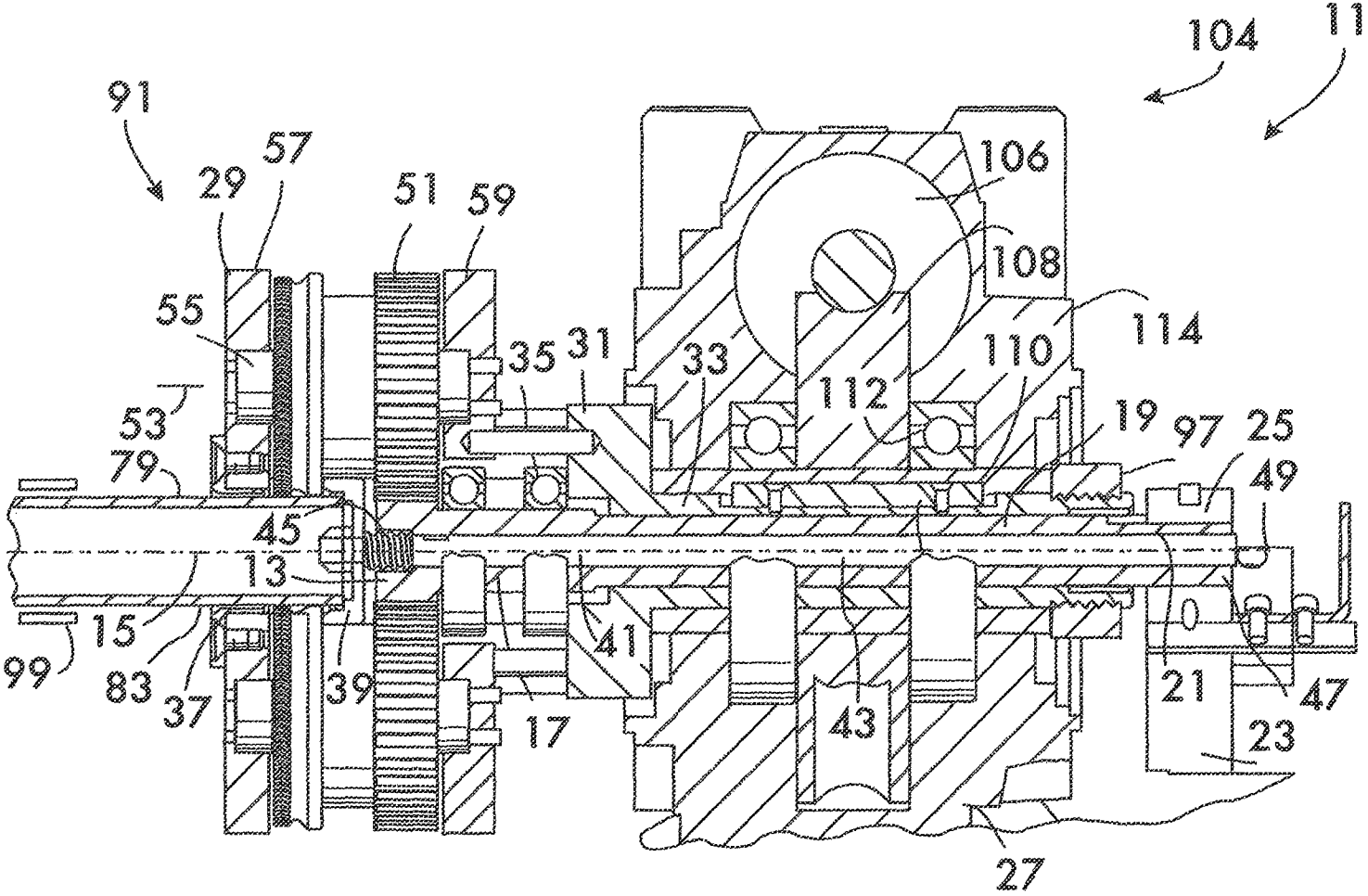
FIG. 9 is a longitudinal sectional view of an example device for forming circumferential grooves in pipe elements.
Figure 9A:
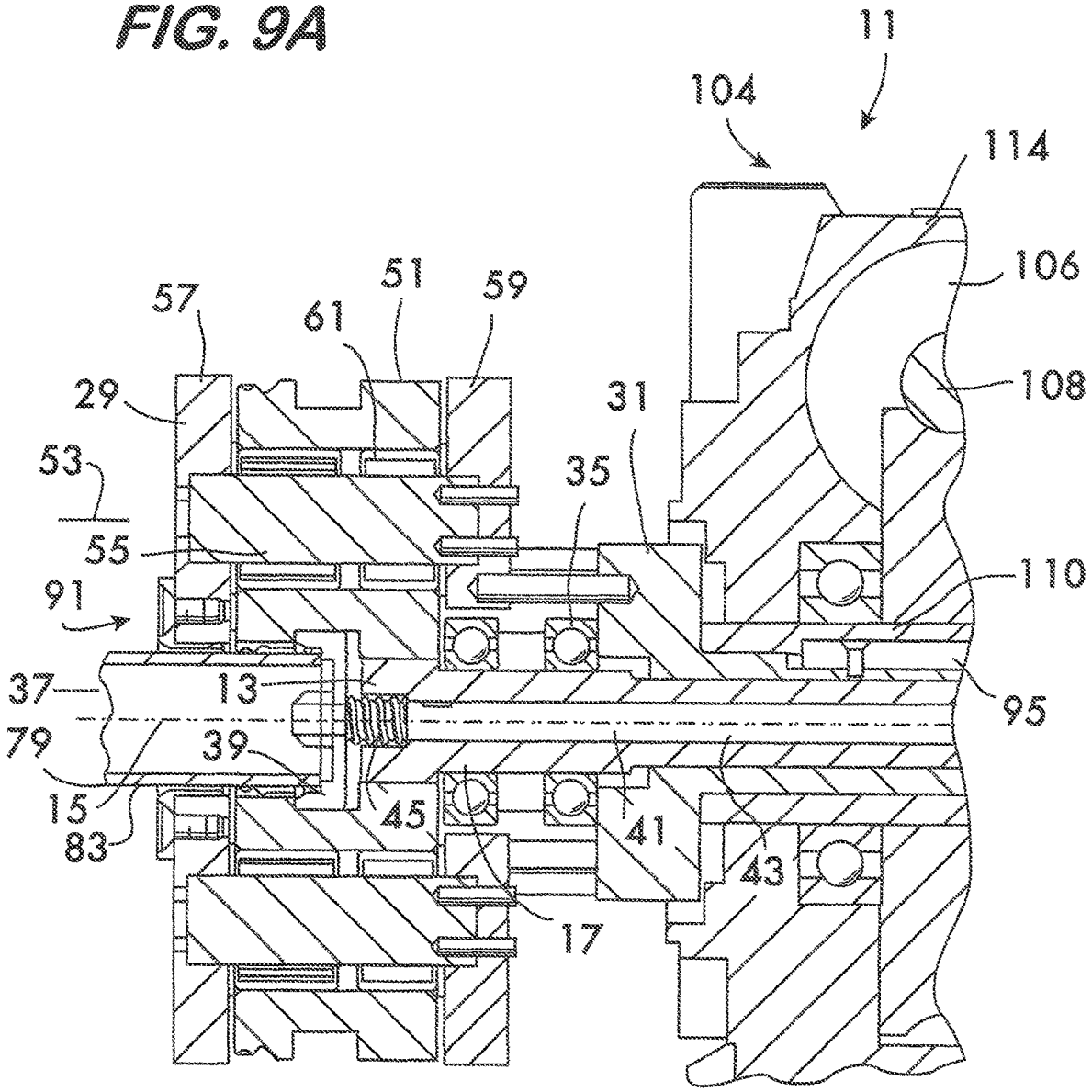
FIG. 9A is a longitudinal sectional view on an enlarged scale of a portion of the device shown in FIG. 9.

FIG. 9 shows another device 11 for forming a circumferential groove in a pipe element. Device 11 comprises a pinion 13 fixedly mounted against rotation about a pinion axis 15 arranged coaxially with the pinion. Rotational fixity of the pinion 13 is accomplished by mounting it on one end 17 of a pinion shaft 19, the opposite end 21 of the pinion shaft being fixed to a post 23 by a key 25. The post is mounted on a base 27.

Figure 11:
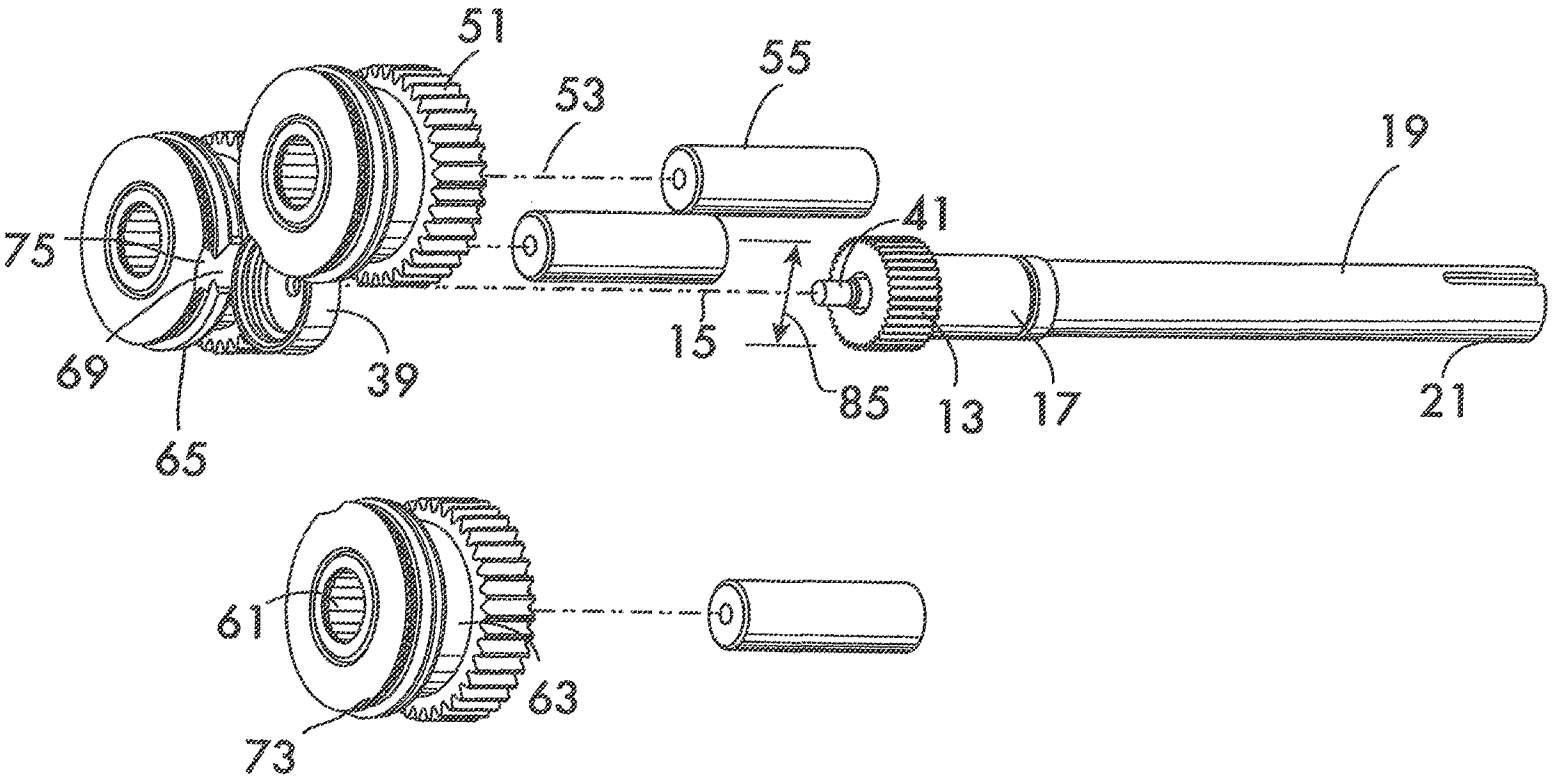
FIG. 11 is an exploded isometric view of selected components of the device shown in FIG. 9.

A carriage 29 surrounds the pinion 13. Carriage 29 is mounted on the flange 31 of a drive shaft 33. Drive shaft 33 is hollow, surrounds and is coaxial with the pinion shaft 19. Bearings 35 positioned between the drive shaft 33 and the pinion shaft 19 permit the drive shaft, and hence the carriage 29 attached thereto, to rotate about the pinion axis 15. The carriage 29 defines an opening 37 for receiving a pipe element in which a groove is to be formed. Opening 37 is arranged coaxially with the pinion axis 15. As shown in FIGS. 9 and 11, a cup 39 is mounted coaxially with the pinion 13. The pipe element abuts the cup 39, and in this example is mounted on a cup shaft 41 which extends coaxially through a bore 43 in the hollow pinion shaft 19. Cup shaft 41 is movable axially along pinion axis 15 and is biased toward the opening 37 by a spring 45 acting between the pinion shaft 19 and the cup 39. The end 47 of the cup shaft 41 opposite to cup 39 is used in conjunction with a switch 49 mounted adjacent to the post 23 to activate the device as described below. In this example embodiment the switch comprises a proximity sensor, but could also be a contact switch, such as a micro-switch.

A plurality of gears 51 are mounted on the carriage 29. In the example embodiment shown in FIGS. 9 and 11, the carriage has 3 gears 51 spaced at angles of 120° from one another. Each gear 51 is rotatable about a respective gear axis 53. In a practical embodiment, each gear is mounted on a gear shaft 55 fixed between front and rear plates 57 and 59 comprising the carriage 29. Bearings 61 positioned between each gear 51 and its respective shaft 55 provide for low friction rotation of the gears within the carriage 29. Each gear 51 engages with the pinion 13.

Figure 12:
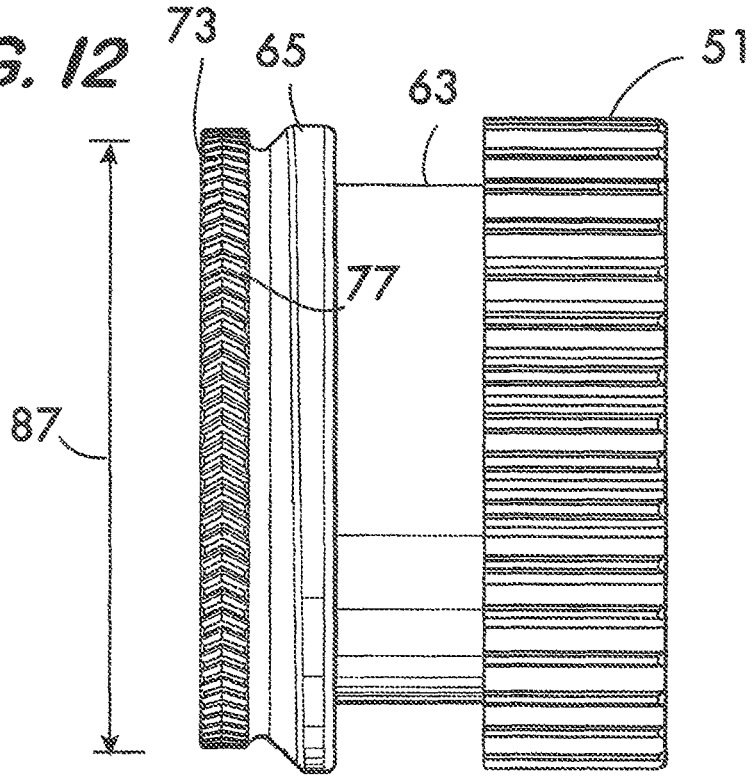
FIG. 12 is a side view of an example cam used in the device shown in FIG. 9 on an enlarged scale.
Figure 13:
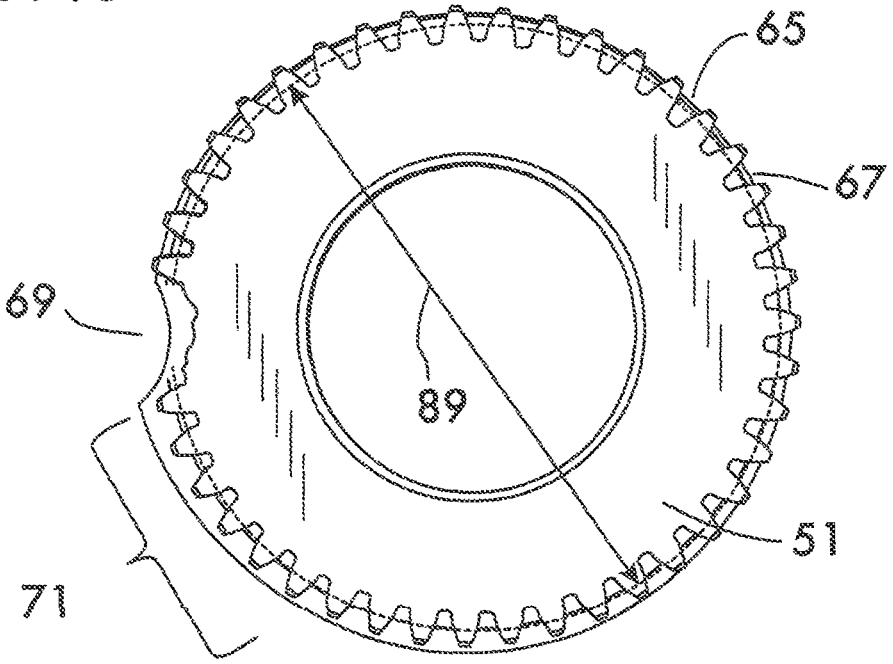
FIG. 13 is an end view of an example cam used in the device shown in FIG. 9 on an enlarged scale.

As shown in FIG. 12, a respective cam body 63 is mounted on each gear 51. A respective cam surface 65 extends around each cam body 63. Cam surfaces 65 are engageable with the pipe element received through the opening 37 and abutting the cup 39. As shown in FIG. 13, each cam surface 65 comprises a region of increasing radius 67 and a discontinuity 69 of the cam surface. Discontinuity 69 is a position on the cam body 63 where the cam surface 65 does not contact the pipe element. It is further advantageous to include, as part of each cam surface 65, a region of constant radius 71 positioned adjacent to the discontinuity 69. A traction surface 73 (see FIG. 12) extends around at least one of the cam bodies 63. In the example shown in FIG. 11, a respective traction surface 73 extends around each cam body 63. The traction surfaces 73 are also engageable with a pipe element received within the carriage 29, but each traction surface has a gap 75 aligned axially (i.e., in a direction along the gear axis 53) with the discontinuity 69 in the cam surface 65 on each cam body 63. As shown in FIG. 12, the traction surface 73 may comprise a plurality of projections 77 extending outwardly therefrom. The projections provide additional purchase between the pipe element and the traction surface 73 during device operation and may be formed, for example, by knurling the traction surface. The traction surface has pitch circle with a diameter 87. When projections 68 are present on traction surface 64, pitch diameter 87 of the traction surface will be determined by the interaction of projections 87 with pipe element 79, including the impression made by the projections 87 upon pipe element 79. If projections 68 are not present, the pitch circle diameter 87 of the traction surface 64 will equal that of the traction surface. As further shown in FIG. 12, the cam surface 65 is positioned between the gear 51 and the traction surface 73, in spaced relation to the traction surface but proximate to it as compared with the gear.

As shown in FIGS. 9 and 7, a reducing gear train 104 is used to rotate the drive shaft 33 about the pinion axis 15. In this example embodiment the reducing gear train 104 comprises a worm screw 106 driven by a servo motor (not shown) controlled by a microprocessor, such as a programmable logic controller (not shown). The servo motor acts as an indexing drive and has an encoder which provides precise information as to the position of the motor shaft, thereby allowing precise control of the rotation of the worm screw 106.

Worm screw 106 meshes with a worm wheel 108. The worm wheel 108 is mounted on a hollow output shaft 110 supported for rotation about the pinion axis 15 on bearings 112 between the output shaft 110 and a gearbox 114. Output shaft 110 is coupled to the drive shaft 33 by a key 95, thus ensuring rotation of the drive shaft 33 when the output shaft 110 is rotated by the worm screw 106 and worm wheel 108.

Figure 14:
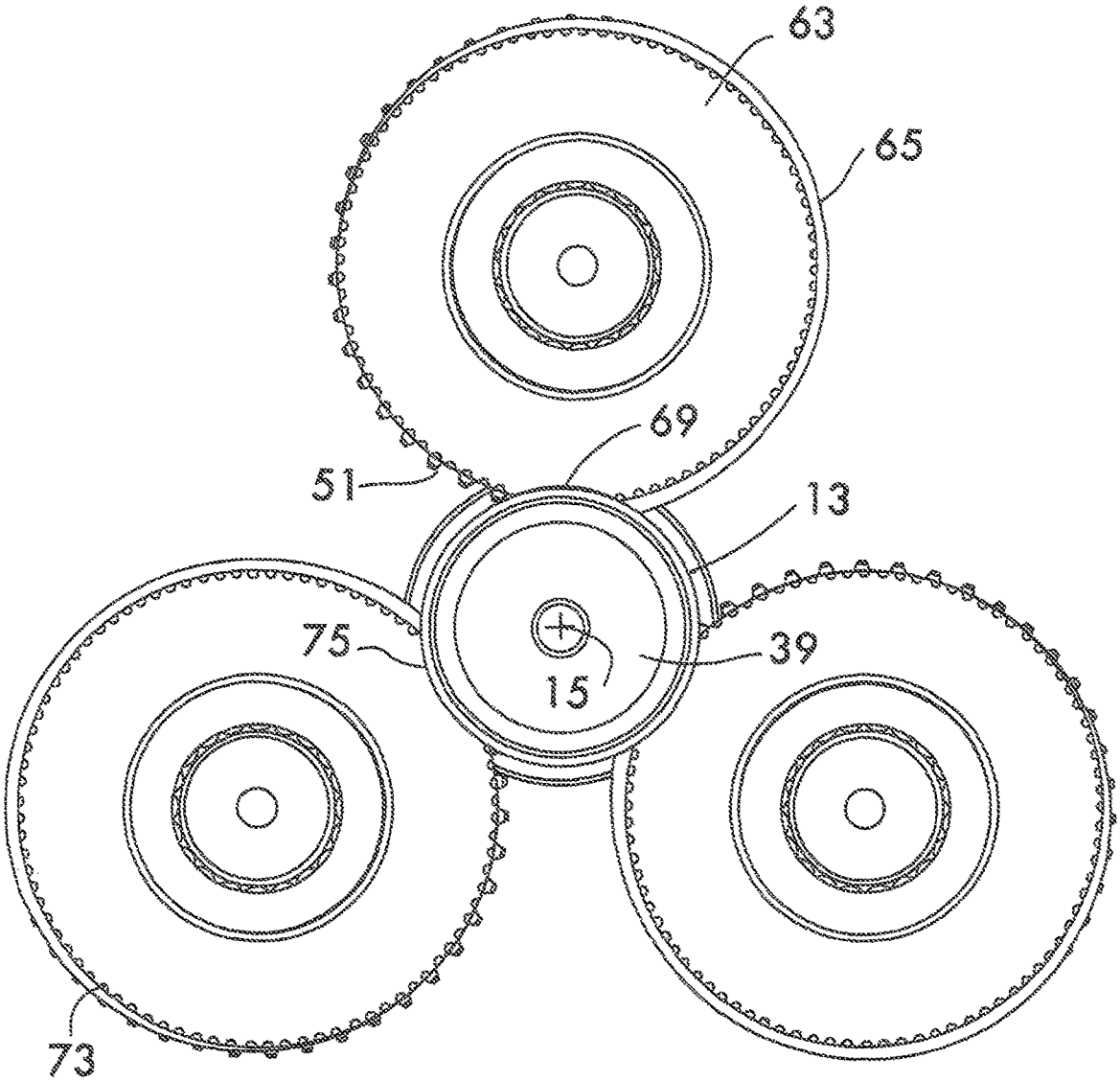
FIG. 14 is an end view of selected components used in the device shown in FIG. 9.

Operation of device 11 begins with the cam bodies 63 positioned as shown in FIG. 14 with the discontinuities 69 in their respective cam surfaces 65 facing the pinion axis 15 and the gaps 75 (see FIG. 11) in their respective traction surfaces 73 also facing pinion axis 15. This orientation of the cam bodies 63 is established upon assembly of the gears 51 with the pinion 13 in the carriage 29 and is set as the start position by the control system and the servo motor (not shown) acting through the worm screw 106 and worm wheel 108.

With the cam bodies 63 in the start position shown in FIG. 14 a pipe element 79 to be grooved is inserted through opening 37 in carriage 29 and abutting the cup 39 (see FIG. 9). The alignment of the gaps 75 in the traction surfaces 73 and the discontinuities 69 in the cam surfaces 63 (see FIG. 11) provide clearance for pipe insertion. The pipe element is further pressed against cup 39, compressing the spring 45 and moving the cup 39 against a positive stop (the face of the pinion shaft 19 in this example) such that an end 47 of the cup shaft 41 interacts with the switch 49, in this example, a proximity switch. Closing switch 49 sends a signal to the control system which commands the servo motor to turn the worm screw 106, which turns the worm wheel 108. In this example rotation of the worm wheel 108 rotates the output shaft 110 counterclockwise (when viewed in FIG. 14) which causes the drive shaft 33 to which it is keyed (key 95) to rotate. Rotation of drive shaft 33 rotates carriage 29 counterclockwise about the pinion axis 15. (The direction of rotation of carriage 29 is determined by the arrangement of the cam surfaces 65 on the cam bodies 63.) This causes the gears 51 and their associated cam bodies 63 to orbit about the pinion axis 15. However, the pinion 13 is fixed against rotation because the pinion shaft 19 is keyed to post 23 by key 25. Because the gears 51 engage pinion 13 the relative rotation of the carriage 29 about the pinion axis 15 causes the gears 51, and their associated cam bodies 63, to rotate about their respective gear axes 53. Rotation of the cam bodies 63 brings traction surfaces 73 and cam surfaces 65 into contact with the outer surface 83 of the pipe element 79. The traction surfaces 73 grip the pipe element 79 while the cam surfaces 65 impress a groove into its outer surface 83 as the region of increasing radius 67 and the region of constant radius 71 of each cam surface 65 traverse the pipe element. The location of the cam surfaces 65 on the cam bodes 63 is coordinated with the position of the pipe element when it is inserted enough so as to reach a positive stop and trip the switch 49 so that the groove is formed at the desired distance from the end of the pipe element. The controller rotates the carriage 29 through as many revolutions as necessary (depending upon the gear ratio between the gears 51 and the pinion 13) to form a circumferential groove of substantially constant depth in the pipe element. Upon completion of groove formation the controller returns the carriage 29 to a position where gaps 75 in the traction surfaces 73 and the discontinuities 69 in the cam surfaces 65 again face the pinion axis 15 (see FIG. 14). This position of the cam bodies 63 allows the pipe element 79 to be withdrawn from the carriage 29, and device 11 is ready to groove another pipe element.

Significant advantage is achieved with the device 11 because it applies minimal torque to the pipe element during the grooving process while forming a groove to a fixed diameter. This condition is achieved when: 1) the pitch circle diameter 85 of pinion 13 (FIG. 11) is equal to the outer diameter of the pipe element 79; and 2) the pitch circle diameter 87 of the traction surfaces 73 is equal to the pitch circle diameter 89 of the gears 51 (FIG. 12). When these two conditions are met, the traction surfaces 73 are constrained to traverse the outer surface of the pipe element with little or no tendency to cause the pipe to rotate, and thus apply only minimal torque to the pipe element. The term "equal" as used herein to refer to the relationship between the pitch circle diameter of the pinion and the outer diameter of the pipe means that the pitch circle diameter is close enough to the outer diameter such that minimal torque is applied to the pipe element. Differences between the pitch circle diameter and the outer diameter of the pipe element on the order of hundredths of an inch fulfill this definition of "equal" in practical applications. Because practical pipe elements have significant diametral tolerances from nominal, it is expected that the relationship between the pitch circle diameter of the traction surface and the outer diameter of the pipe element may be affected by pipe diameter deviation such that torque will be applied to the pipe element, thereby making the use of an external clamp 99 advantageous (see FIG. 9) in these cases.

In a practical example design, a device 11 suitable for grooving 1 inch nominal diameter pipe uses three gears 51 and cam bodies 63 as shown. The outer diameter of 1 inch nominal pipe is 1.315 inches. A pinion 13 having 21 teeth and a pitch circle diameter of 1 5/16 inches (1.3125 inches) is close enough (a difference of 0.0025 inches) such that minimal torque is applied when the pitch circle diameters of the gears and the traction surfaces are also equal to one another. This example embodiment uses gears 51 having 42 teeth with a pitch circle diameter of 2 5/8 inches. The traction surfaces 73, when knurled or otherwise prepared, although not a gear, have an equivalent pitch diameter (i.e., the diameter of a cylinder which gives the same motion as an actual gear), which is impressed into the pipe as it is traversed by the traction surface. Differences between the pitch circle diameter of the traction surfaces and the pitch circle diameter of the gears on the order of hundredths of an inch fulfill this definition of "equal" or "equivalent" in practical applications. Considering the gear ratio between the pinion 13 and the gears 51 in this example, it is clear that the carriage 29 will make two revolutions to form a complete circumferential groove about the pipe element.

In another example design suitable for 2 inch nominal pipe having an outer diameter of 2 3/8 inches (2.375 inches), a pinion having 30 teeth with a pitch circle diameter of 2.362 inches is feasible (a difference of 0.013 inches). This design uses 5 gears, each gear having 30 teeth and a pitch circle diameter of 2.362 inches. The 1:1 ratio between pinion and gear indicate a single carriage revolution is required to form a complete groove. Designs with more than three gears are advantageous when pipe elements having thin walls or larger diameters are being grooved because such pipes have a tendency to bulge elastically over regions between the cams when compressed between three cam surfaces 120° apart from one another. This elastic behavior leads to greater spring back of the pipe elements to their nominal shape and inhibits groove formation. However, more gears mean more cams applying force at more points around the pipe element to better support the pipe element and therefore significantly reduce elastic bulging. More constraints more closely spaced around the pipe element force the deformation largely into the plastic regime where spring back is reduced and compensated for.

Another example design uses 4 gears and cams for pipe elements of 1.25 and 1.5 inch nominal diameter. Gear to pinion ratios of 1.5:1 and 1:1 are also feasible for this design.

Device 11 is designed such that the carriage 29 and its associated gears 51, cam bodies 63, pinion 13, cup shaft 41, cup 39, spring 45, drive shaft 33 and pinion shaft 19 constitute an assembly 91 interchangeable with the gear train 104 to permit the device to be readily adapted to groove a range of pipes having different diameters and wall thicknesses. Interchangeability is afforded by the use of key 25 between the pinion shaft 19 and the post 23, and the key 95 between the drive shaft 33 and the output shaft 110, coupled with a retaining nut 97 threaded with the drive shaft 33 and acting against the output shaft 110. The assembly 91 can be removed by sliding it along the pinion axis 15 when the retaining nut 97 is out of threaded engagement with drive shaft 33. A different carriage assembly, suitable for grooving a different pipe element, may then be substituted.

Devices 11 according to the invention are expected to increase the efficiency of pipe grooving operations because they will operate rapidly, accurately and safely on a wide range of pipe element sizes and schedules without the need for stands to support the pipe element and accommodate its rotation and ensure alignment. Device 11 will also permit pipe assemblies having elbow joints to be grooved without concern for rotation of the transverse pipe element's motion.

Figure 15:
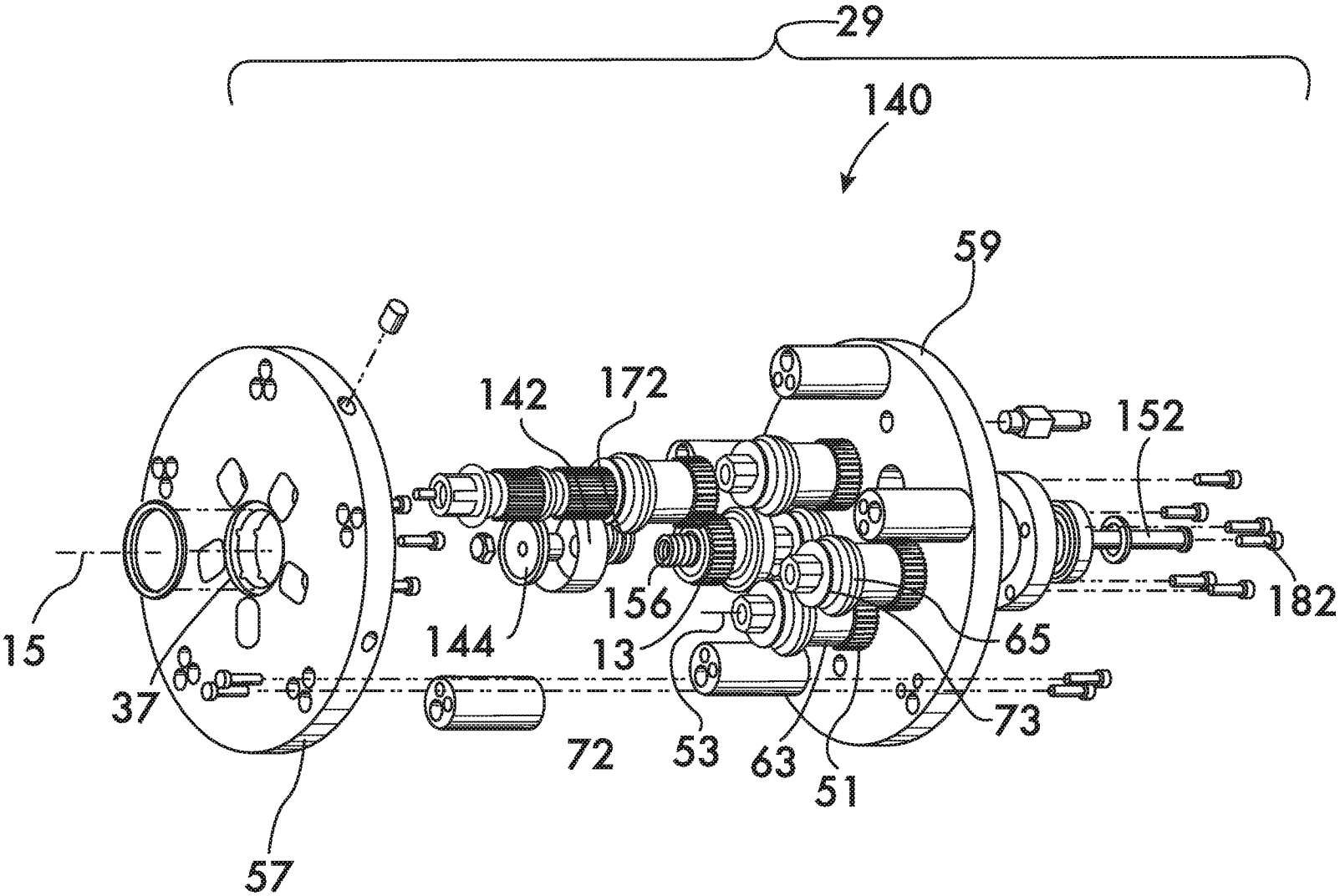
FIG. 15 is an exploded isometric view of another example embodiment of a portion of device for forming circumferential grooves in pipe elements according to the invention.
Figure 16:
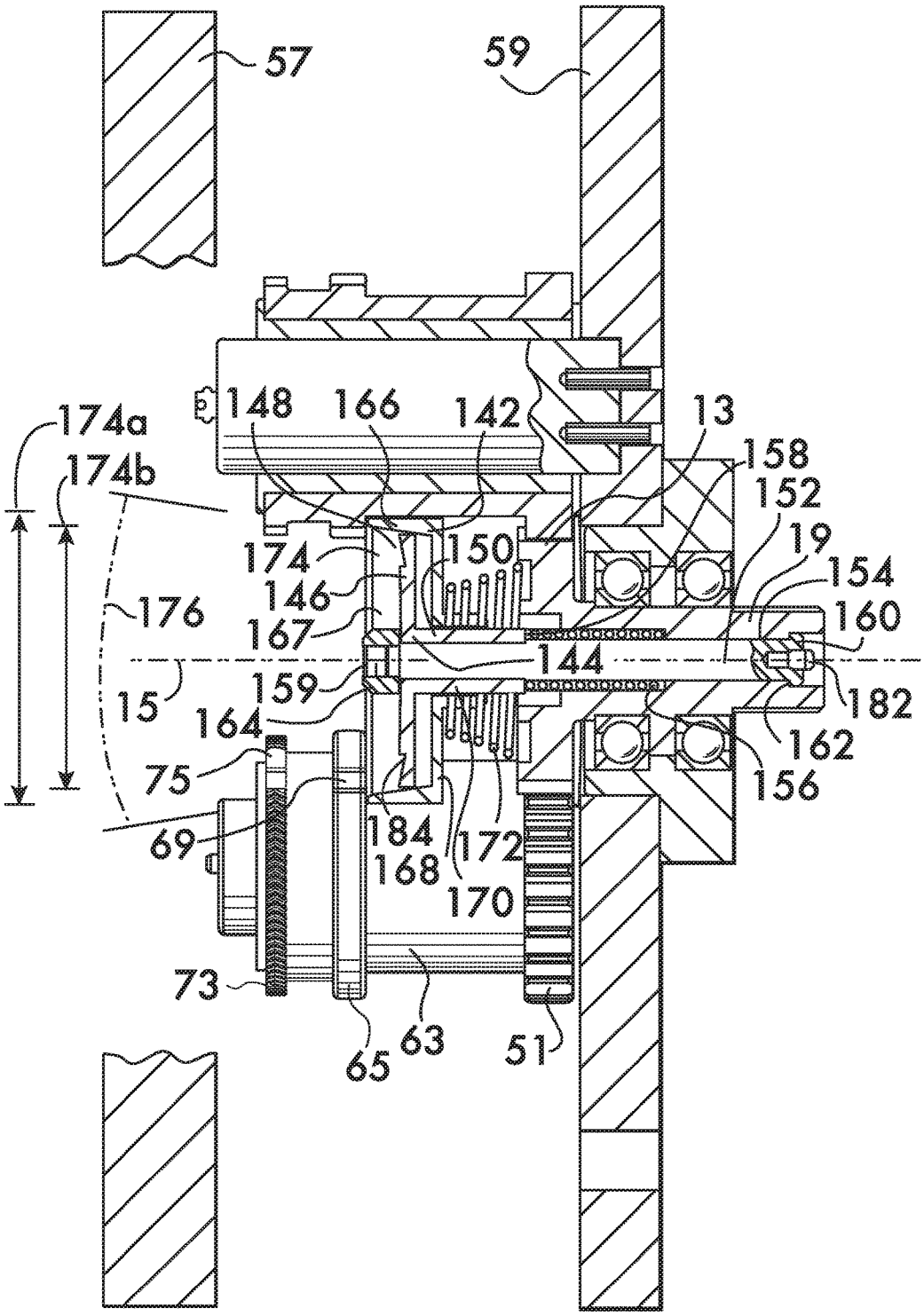
FIG. 16 is a sectional side view of the device shown in FIG. 15.

FIGS. 15-20 illustrate another example embodiment of a grooving device 140 according to the invention. Similar to device 11 described above, device 140 comprises a plurality of gears 51, the embodiment 140 shown in FIG. 15 having five gears. As shown in FIGS. 12 and 13, each gear 51 comprises a cam body 63 which supports a cam surface 65 and optionally a traction surface 73. The various characteristics of the gears, cam surfaces and tractions surfaces are described above. As shown in FIG. 15, the gears 51 are rotatably mounted on a carriage 29 which itself rotates about a pinion axis 15 the same as device 11. As described above, carriage 29 comprises front and rear plates 57 and 59, the front plate 57 defining an opening 37 for receiving the pipe element to be grooved. As shown in FIG. 16, at least one of the gears 51 meshes with (directly engages) a pinion 13 which is coaxially mounted on a pinion shaft 19. (In the example embodiment shown, all of the gears directly engage the pinion 13.) Both the pinion 13 and the pinion shaft 19 are arranged coaxially with respect to pinion axis 15 (see FIG. 16) and both are fixed in rotation relative to the carriage 29. For operation of grooving device 140, carriage 29 may be mounted in place of device 11 on the drive shaft 33 shown in FIG. 9, and, as described above for device 11, when the carriage is rotated about the pinion axis 15 the gears 51 rotate about their respective gear axes 53, the cam surfaces 65 forming circumferential grooves in a pipe element.

As shown in FIG. 16, device 140 differs from device 11 because it has a flared cup 142 positioned adjacent to pinion 13 and surrounding a pipe end stop 144. The pipe end stop 144 comprises a plate 146 defining a pipe engaging surface 148. Plate 146 is mounted on and extends outwardly from a sleeve 150 which is fixedly mounted on a cup shaft 152. The cup shaft 152 is received within a bore 154 of the pinion shaft 19 coaxially aligned with the pinion axis 15. A first end 159 of cup shaft 152 projects from the bore 154 and both the cup 142 and the pipe end stop 144 are mounted proximate to projecting first end 159 of cup shaft 152. Cup shaft 152 is movable in a direction along the pinion axis 15 relative to the pinion shaft 19 and is biased toward the cam surfaces 65 of cam bodies 63 by a stop spring 156, in this example a coil spring arranged coaxially about the pinion axis 15 and acting between the pinion shaft 19 and a shoulder 158 of the sleeve 150. Cup shaft 152 is retained within the pinion shaft bore 154 against the biasing force of spring 156 through engagement between an enlarged second end 160 of the cup shaft and an undercut 162 in the pinion shaft bore 154. In this example, a threaded nut 164 engages the first end 159 of the cup shaft 152 to retain the pipe end stop 144 to the cup shaft.

The cup 142 comprises a sidewall 166 arranged coaxially with the pinion axis 15. Sidewall 166 defines an interior 167 and surrounds the plate 146 of the pipe end stop 144. A radially extending back wall 168 connects the sidewall 166 to an axially extending hub 170. The hub 170 receives the cup shaft 152 by engaging the sleeve 150 of the pipe end stop 144 and is movable relatively thereto along the pinion axis 15. A cup spring 172 may act between the cup 142 and the pinion 13 to bias the cup 142 away from pinion 13. In this example spring 172 is a conical spring which compresses flatter to permit a greater range of axial motion to the cup 142 than would be possible using a straight compression coil spring. Cup 142 thus "floats" (moves independently) relative to the pipe end stop 144. Sidewall 166 defines an inner surface 174 which engages pipe elements as described below. The inner surface 174 has a first diameter 174*a* located distal to the pinion 13 and a second diameter 174*b* located proximate to the pinion. The first diameter 174*a* is larger than the second diameter 174*b*, yielding the flared cup 142. The pipe end stop 144 is positioned within the interior 167 between the first and second diameters 174*a* and 174*b*. In one example embodiment the inner surface 174 is advantageously conical. In a practical design the inner surface 174 defines an included angle 176 which may range between about 11° (for 1.25 inch diameter pipe) to about 12° (for 1.5 inch diameter pipe) and up to about 16° (for 2 inch diameter pipe). The taper of the conical surface 174 is designed such that the cup 142 engages a pipe element before the pipe end stop 144 as described below.

Figure 10:
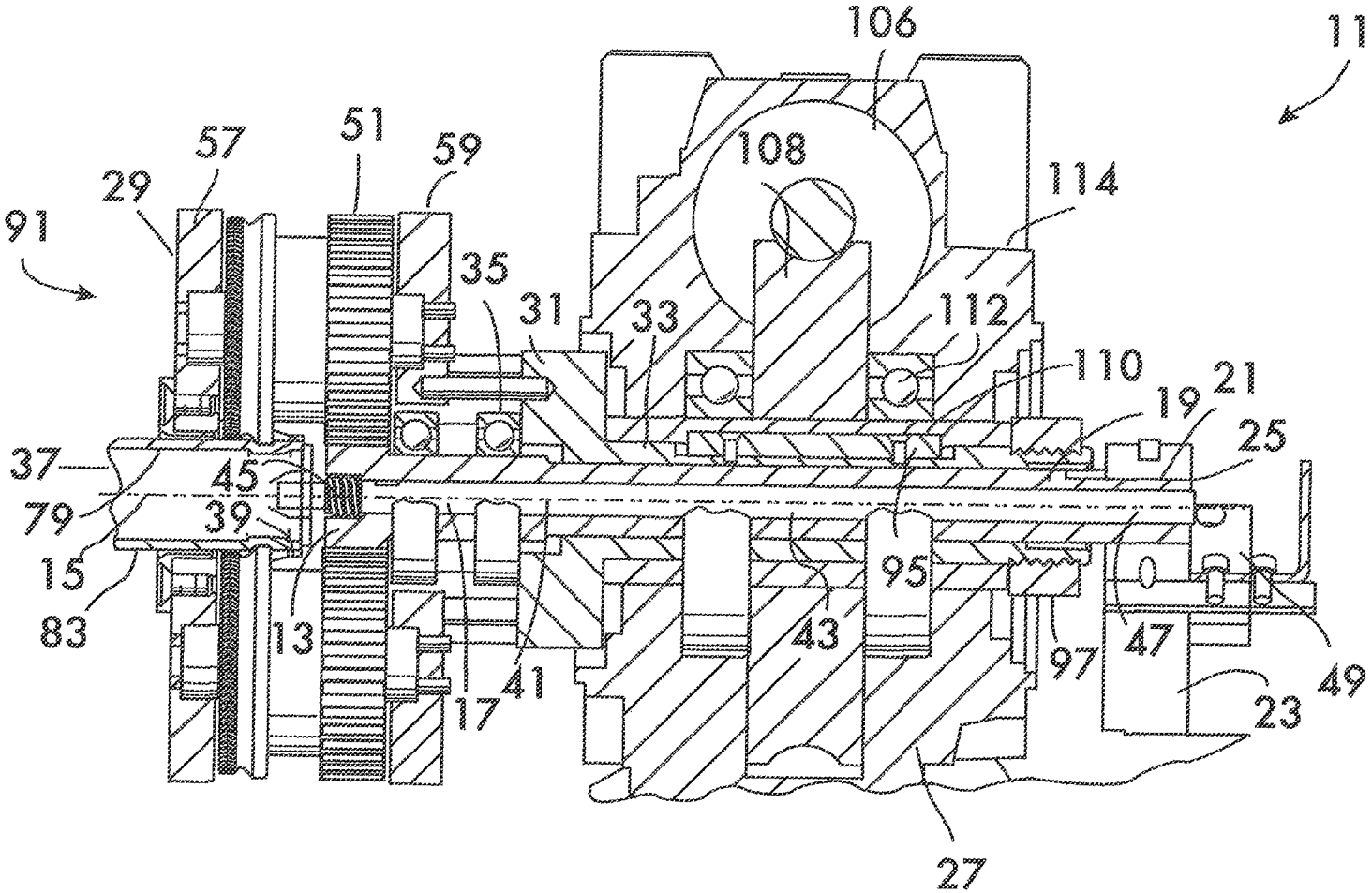
FIG. 10 is a longitudinal sectional view of the device shown in FIG. 9 forming a circumferential groove in a pipe element.
Figure 10A:
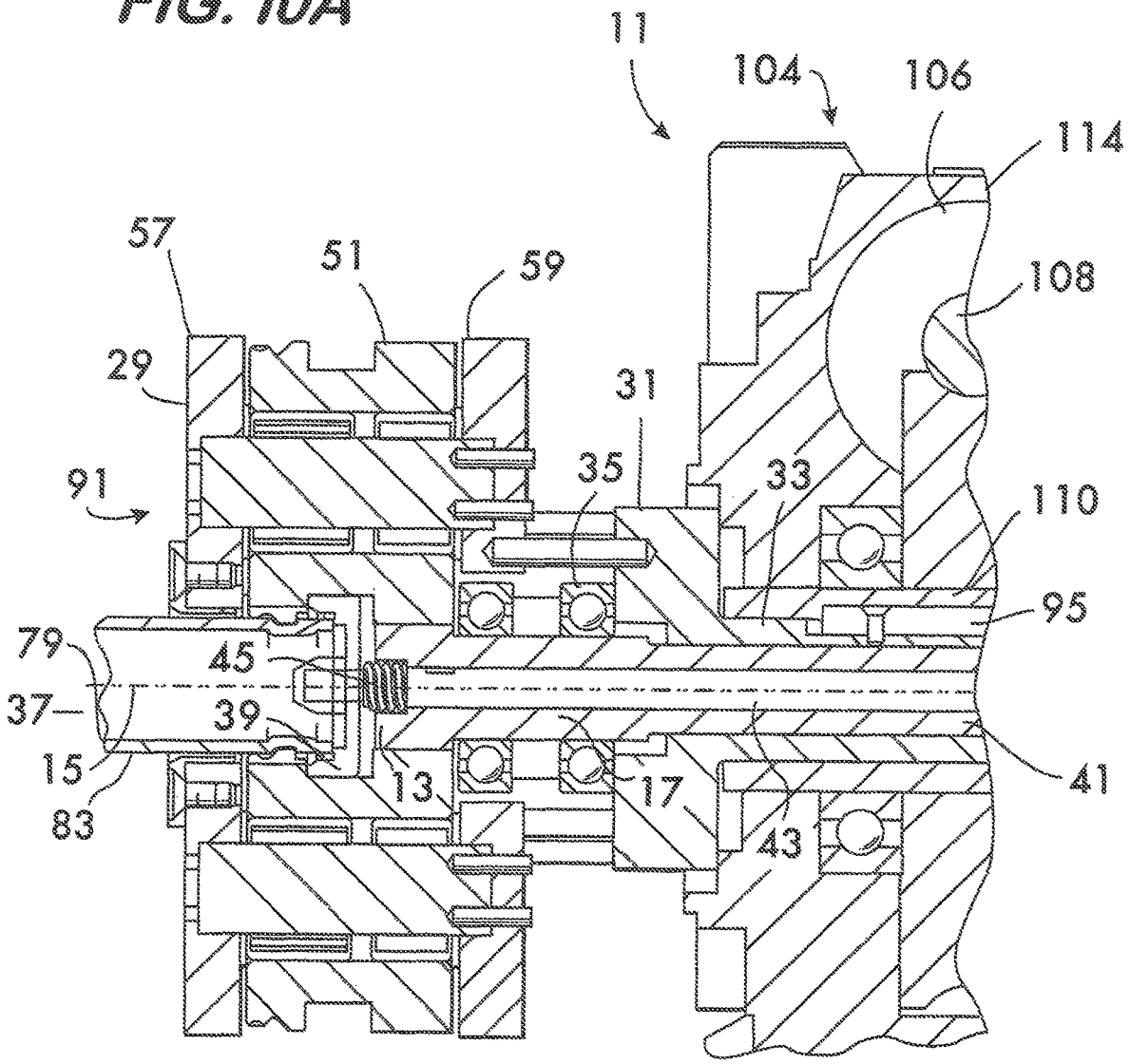
FIG. 10A is a longitudinal sectional view on an enlarged scale of a portion of the device shown in FIG. 10.
Figure 17:
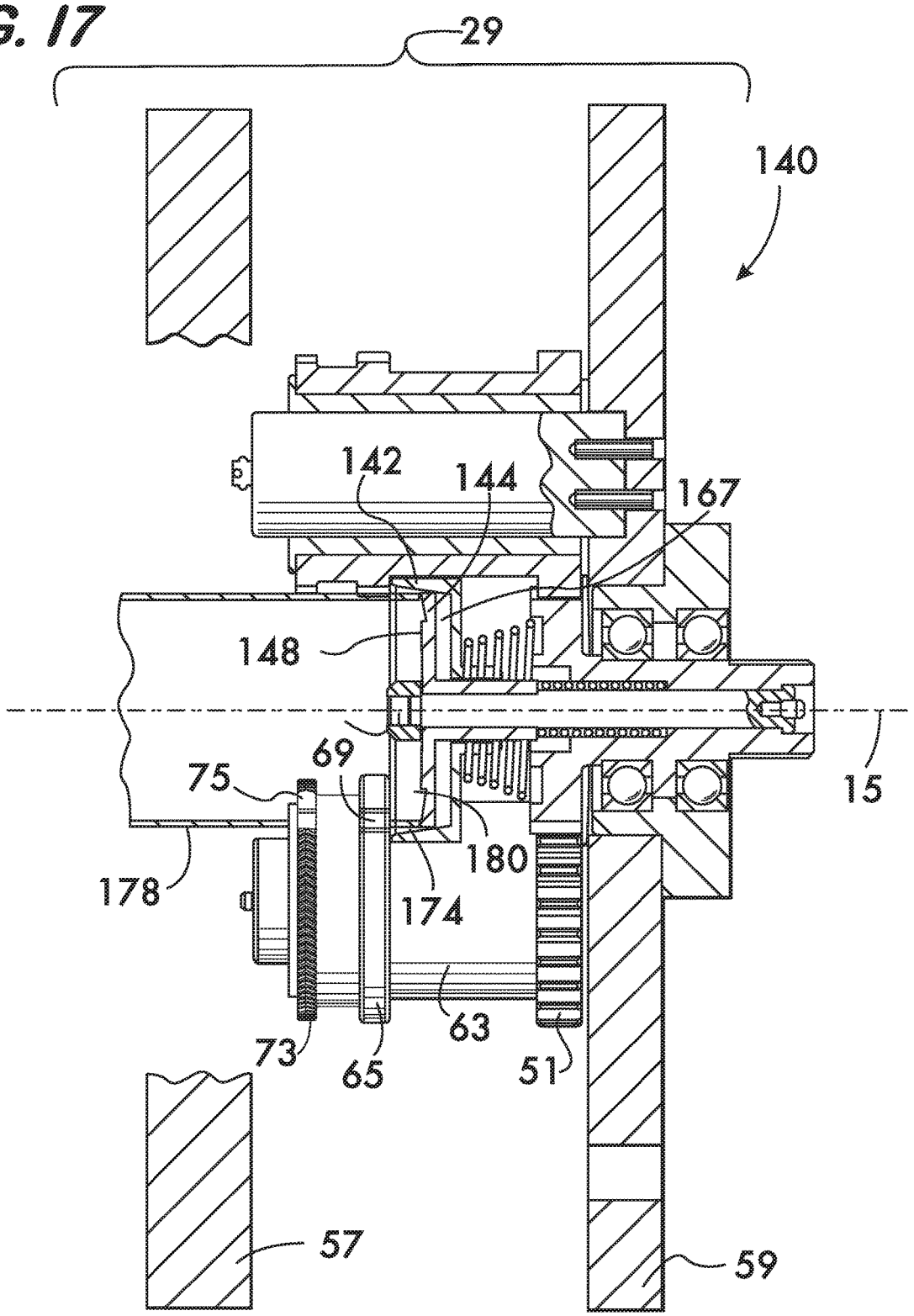
FIGS. 17-19 are sectional side views of the device shown in FIG. 15 illustrating operation of the device.
Figure 18:
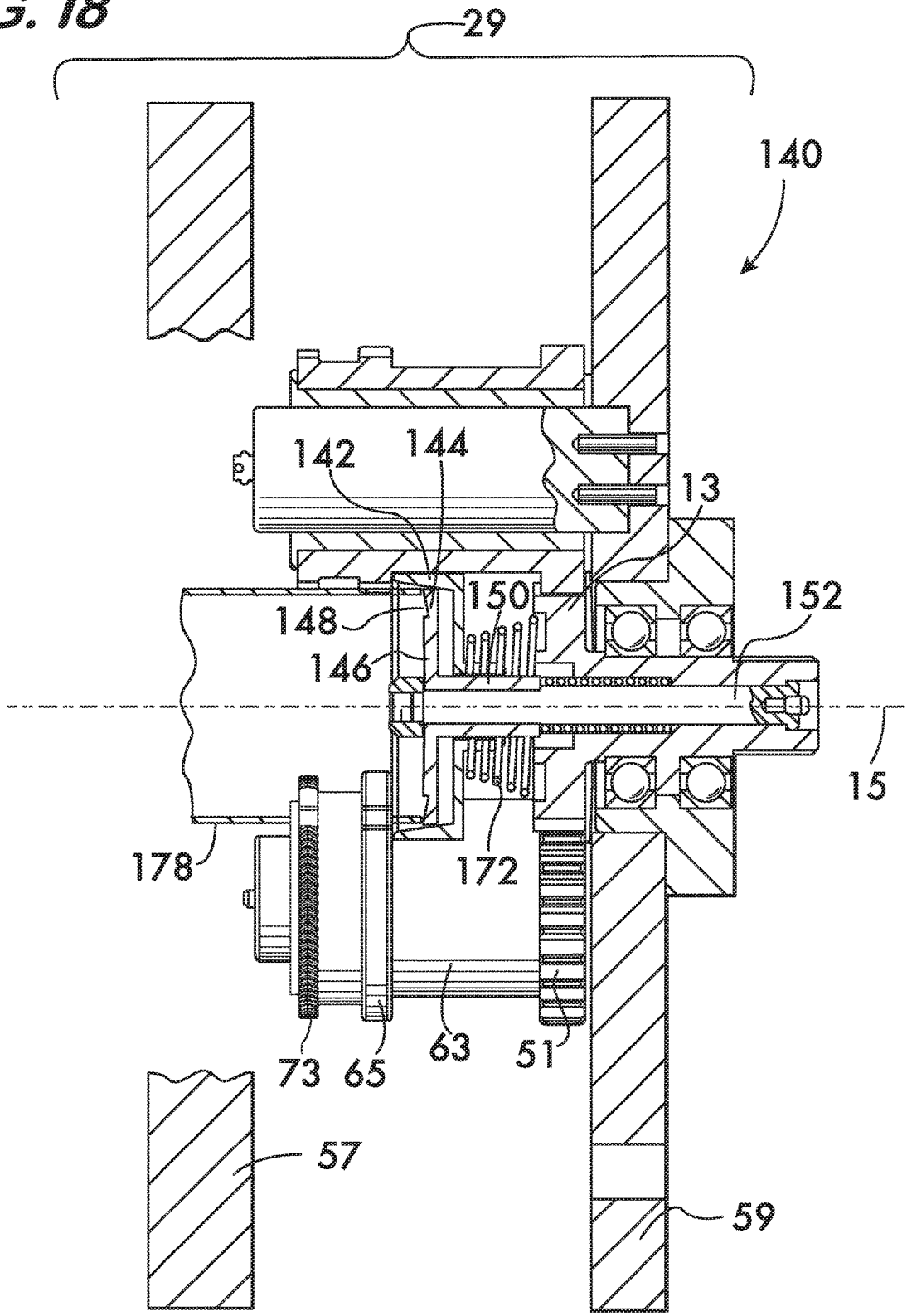
Figure 19:
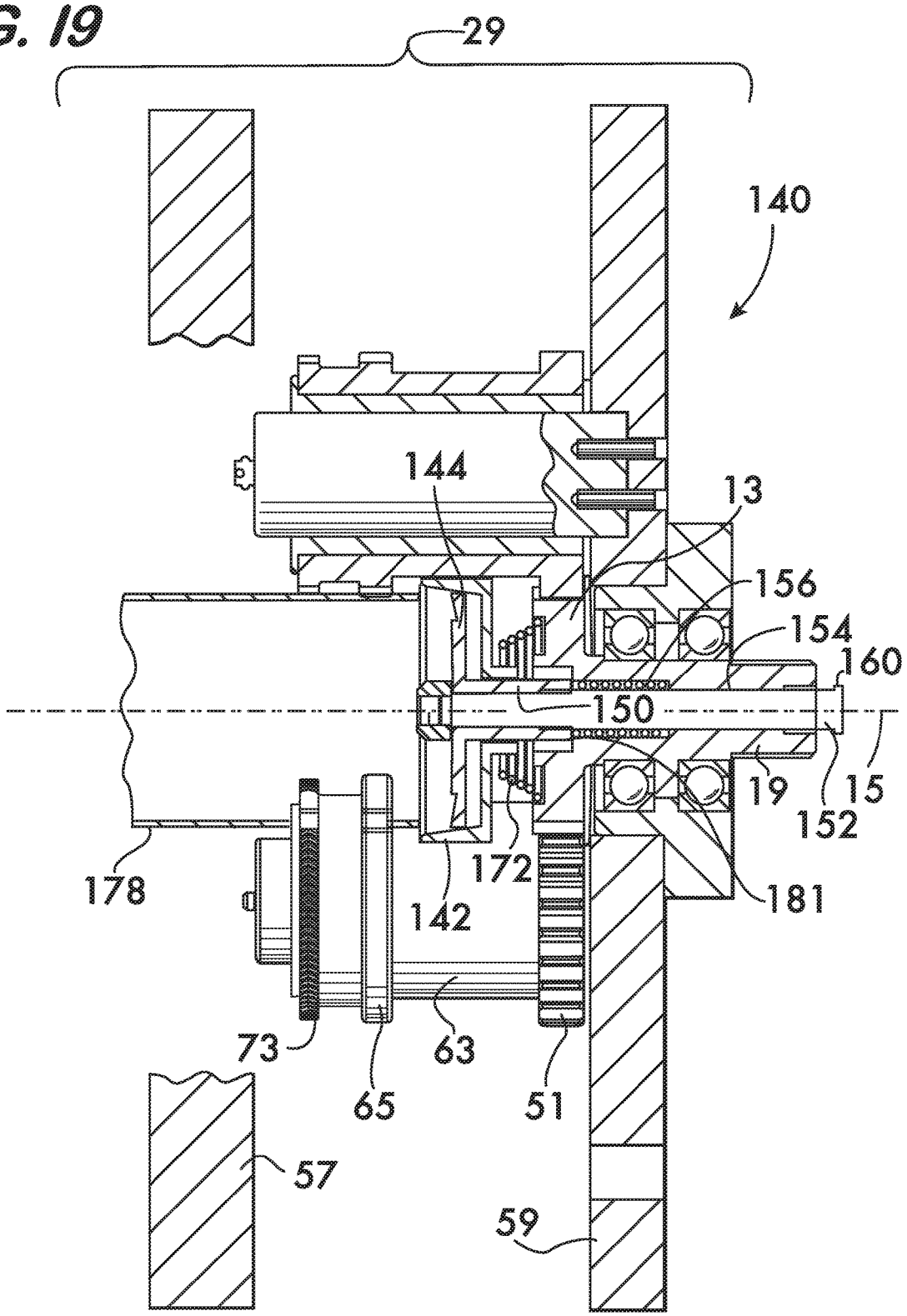
Figure 20:
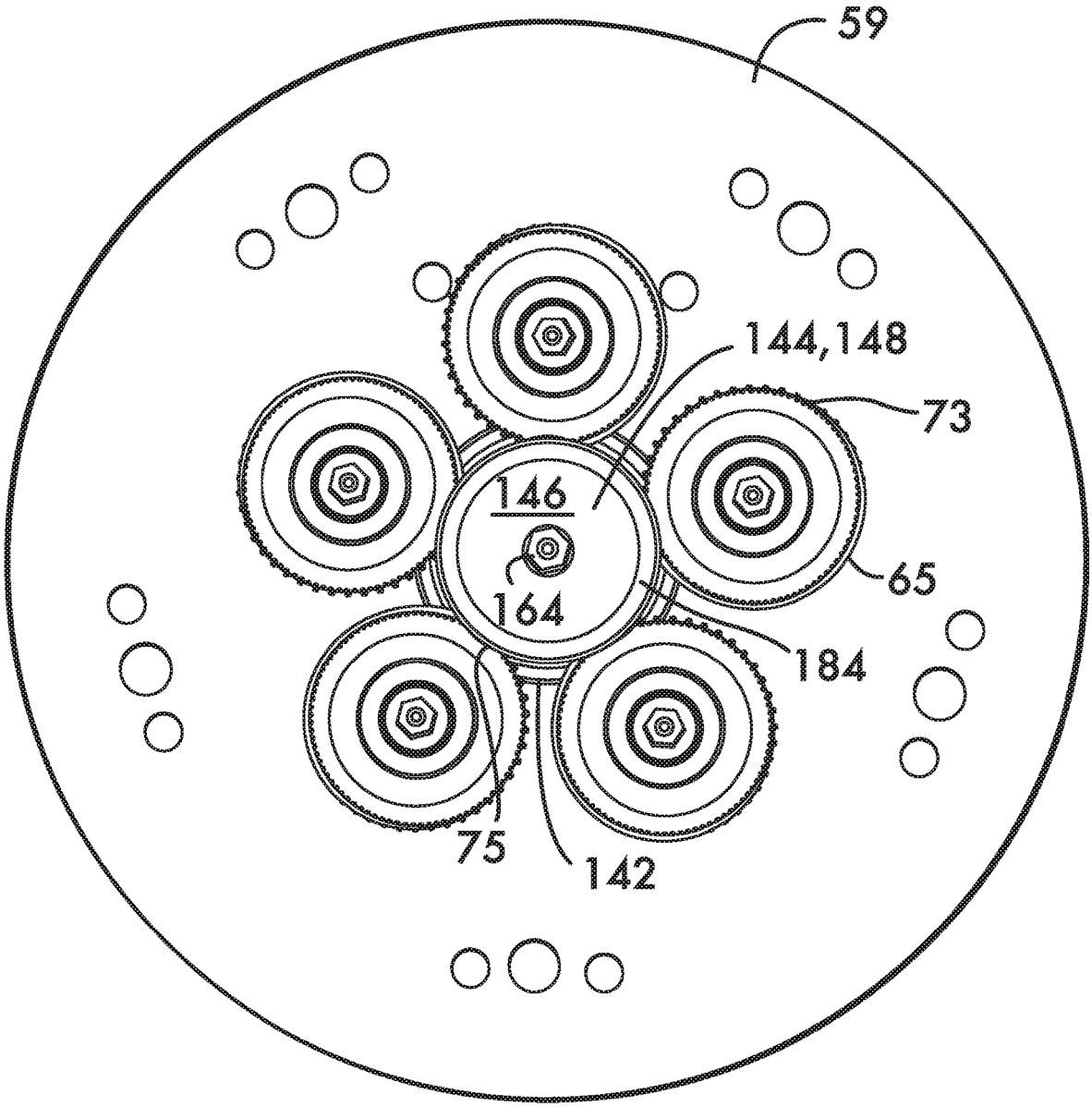
FIG. 20 is a front sectional view of the device shown in FIG. 15.

Operation of the flared cup 142 and pipe end stop 144 is described with reference to FIGS. 17-19. As shown in FIG. 17, with cam and traction surfaces 65 and 73 oriented with their respective discontinuities 69 and gaps 75 facing the pinion axis 15, a pipe element 178 is inserted into the carriage 29 and received within the cup 142. Upon pipe element insertion the outer circumference of the end of the pipe element 178 first engages the inner surface 174 (note the gap 180 between the pipe element and the pipe engaging surface 148 of the pipe end stop 144). The taper of the inner surface 174 is designed to accommodate the dimensional tolerance on the pipe element diameter such that the gap 180 initially exists regardless of the actual diameter of a particular pipe element. In the example shown in FIG. 17 the pipe element 178 is at the smaller end of the diameter tolerance range and the pipe element engages relatively deeply into the cup interior 167. As shown in FIG. 18, the pipe element 178 is inserted further into the carriage 29. In response, cup 142 moves axially along sleeve 150 relative to the pipe end stop 144 and cup shaft 152, compressing the cup spring 172 between pinion 13 and the cup 142. Axial motion of the cup 142 independent of the pipe end stop 144 continues until the gap 180 is closed and the end of pipe element 178 engages the pipe engaging surface 148 of the plate 146. As shown in FIG. 19, continued insertion of the pipe element 178 moves the pipe end stop 144 relative to the pinion 13, compressing both the spring 172 and the coil spring 156. Axial motion of the pipe element 178, the cup 142 and the pipe end stop 144 is halted when the sleeve 150 of the pipe end stop engages an internal shoulder 181 within the bore 154 of the pinion shaft 19 (compare FIGS. 18 and 19). The sleeve 150 and internal shoulder 181 are dimensioned to accomplish two effects: 1) to position the pipe element 178 relative to the cam surfaces 65 so that a circumferential groove formed in the pipe element when the carriage 29 rotates will be at the desired distance from the end of the pipe element; and 2) to position the enlarged end 160 of the cup shaft 152 so as to trip a switch which activates device 140, rotating the carriage 29 to form the circumferential groove when the pipe element 178 is in the proper position. Similar to device 11, the switch may be a proximity sensor 49 as shown in FIG. 10. As shown in FIG. 16, a threaded screw 182 may be positioned in the enlarged end 160 of the cup shaft 152 to provide adjustability of the apparent length of the cup shaft 152 for fine tuning of the switch throw. As shown in FIGS. 16 and 20, increased accuracy of the position of the circumferential groove on the pipe element 178 may be afforded in certain circumstances by the use of a reverse cone surface 184 in the pipe engaging surface 148 of plate 146. This feature is advantageous when pipe elements cut by a roll cutter are being grooved. Roll cutters work, not by removing material (kerf cut), but by using a wedge-shaped blade to separate material at the cutting plane. The cut end of the pipe element will have a tapered outer surface as a result. The reverse cone surface 184 is designed to accommodate this tapered outer surface and ensure that the circumferential groove is positioned at the desired distance from the end of the pipe element 178, measured from the point at which the pipe element is at its full outer diameter, and not at the end of the tapered surface. Reverse cone angles up to about 5° may be used in practical designs of the reverse cone surface 184.

Use of the floating cup 142 according to the invention provides the following advantages: 1) the cup accommodates the dimensional tolerance of the pipe element outer diameter; 2) the cup limits radial expansion of the end of the pipe element during grooving and thereby reduces flare (permanent radial deformation); and 3) the cup limits localized outward bulging of the pipe element in the regions between the cam surfaces 65 of the plurality of cam bodies 63 and thus helps prevent the end of the pipe element from going "out of round". It is expected that example devices 140 according to the invention will enable pipe elements to be grooved more rapidly and more accurately than grooving devices according to the prior art.

What is claimed is:

1. A device for forming a circumferential groove in a pipe element, said device comprising:

a pinion fixed against rotation about a pinion axis arranged coaxially with said pinion;

a carriage surrounding said pinion, said carriage being rotatable about said pinion axis and defining an opening arranged coaxially with said pinion axis for receiving said pipe element;

a cup positioned adjacent to said pinion, said cup having a sidewall arranged coaxially with said pinion axis and defining an interior, said sidewall having an inner surface, said inner surface have a first diameter located distal to said pinion and a second diameter located proximate to said pinion, said first diameter being larger than said second diameter, said interior facing said opening for receiving said pipe element, said cup being movable along said pinion axis toward and away from said pinion;

a pipe end stop positioned within said interior between said first and second diameters, said pipe end stop being movable along said pinion axis toward and away from said pinion relatively to said cup;

a stop spring acting on said pipe end stop and biasing said pipe end stop away from said pinion;

a plurality of gears mounted on said carriage, each said gear being rotatable relatively to said carriage about a respective gear axis, at least one of said gears engaging directly with said pinion;

a plurality of cam bodies, each said cam body mounted on a respective one of said gears;

a plurality of first cam surfaces, each one of said first cam surfaces extending around a respective one of said cam bodies and engageable with said pipe element received within said opening, each one of said first cam surfaces comprising a region of increasing radius, each one of said first cam surfaces comprising a first discontinuity of said first cam surface.

2. The device according to claim 1, wherein each said gear engages directly with said pinion.

3. The device according to claim 2, wherein each said gear has a same pitch circle diameter.

4. The device according to claim 1, further comprising a cup spring acting between said cup and said pinion and biasing said cup away from said pinion.

5. The device according to claim 4, wherein said cup spring comprises a conical spring.

6. The device according to claim 1, wherein said sidewall has a conical inner surface.

7. The device according to claim 6, wherein said conical inner surface defines an included angle from 11° to 16°.

8. The device according to claim 1, further comprising a pinion shaft, said pinion being fixedly mounted on said pinion shaft, said carriage being rotatably mounted on said pinion shaft.

9. The device according to claim 8 wherein said pinion shaft defines a bore coaxially aligned with said pinion axis.

10. The device according to claim 9, further comprising a cup shaft positioned within said bore, said cup shaft being movable along said pinion axis within said bore, a first end of said cup shaft projecting from said bore, said cup being mounted proximate to said first end of said cup shaft.

11. The device according to claim 10, wherein said cup comprises:

a hub coaxially receiving said cup shaft;

a back wall extending outwardly from said hub, said sidewall being attached to said back wall.

12. The device according to claim 10, wherein said pipe end stop comprises:

a sleeve fixedly mounted on said cup shaft;

a plate mounted on said sleeve and extending outwardly therefrom, said plate defining a pipe engaging surface facing said opening.

13. The device according to claim 12, wherein said plate further comprises a reverse cone surface positioned within said pipe engagement surface, said reverse cone surface having an increasing slope when measured in a direction extending radially from said sleeve.

14. The device according to claim 12, wherein said cup comprises:

a hub coaxially receiving said sleeve;

a back wall extending outwardly from said hub, said sidewall being attached to said back wall.

15. The device according to claim 8, further comprising:

a base;

a post mounted on said base, said pinion shaft being fixedly mounted on said post.

16. The device according to claim 1, wherein each one of said first cam surfaces comprises a region of constant radius positioned adjacent to a respective one of said first discontinuities.

17. The device according to claim 1, further comprising at least one traction surface extending around one of said cam bodies, said at least one traction surface having a gap therein, said gap being aligned axially with said first discontinuity of said first cam surface surrounding said one cam body.

18. The device according to claim 17, wherein said at least one traction surface comprises a plurality of projections extending outwardly therefrom.

19. The device according to claim 17, wherein said at least one traction surface is positioned proximate to said first cam surface surrounding said one cam body.

20. The device according to claim 17, wherein said pinion has a pitch circle diameter equal to an outer diameter of said pipe element.

21. The device according to claim 20, wherein said at least one traction surface has a pitch circle diameter equal to a pitch circle diameter of one of said gears.

22. The device according to claim 20, further comprising a plurality of said traction surfaces, each one of said traction surfaces extending around a respective one of said cam bodies, each one of said traction surfaces having a gap therein, each said gap being aligned axially with a respective one of said discontinuities of said first cam surfaces on each one of said cam bodies, each one of said traction surfaces having a pitch circle diameter equal to said pitch circle diameters of said gears.

23. The device according to claim 1, comprising at least three said gears.

24. The device according to claim 1, comprising at least five said gears.

* * * * *